US009924576B2

(12) United States Patent
Johnston et al.

(10) Patent No.: US 9,924,576 B2
(45) Date of Patent: Mar. 20, 2018

(54) METHODS, APPARATUSES, AND SYSTEMS FOR OPERATING LIGHT EMITTING DIODES AT LOW TEMPERATURE

(71) Applicant: Digital Lumens, Inc., Boston, MA (US)

(72) Inventors: Scott D. Johnston, Boston, MA (US); Christopher Elledge, Arlington, MA (US); Hugh Medal, Everett, MA (US); Frederick M. Morgan, Canton, MA (US); John F. Egan, Middleton, MA (US)

(73) Assignee: Digital Lumens, Inc., Boston, MA (US)

( * ) Notice: Subject to any disclaimer, the term of this patent is extended or adjusted under 35 U.S.C. 154(b) by 0 days.

(21) Appl. No.: 14/927,413

(22) Filed: Oct. 29, 2015

(65) Prior Publication Data

US 2016/0050725 A1 Feb. 18, 2016

Related U.S. Application Data

(63) Continuation of application No. PCT/US2014/035990, filed on Apr. 30, 2014.
(Continued)

(51) Int. Cl.
*H05B 33/08* (2006.01)

(52) U.S. Cl.
CPC ..... *H05B 33/089* (2013.01); *H05B 33/083* (2013.01); *H05B 33/0812* (2013.01);
(Continued)

(58) Field of Classification Search
CPC ..... H05B 33/083; H05B 33/0866; H05B 33/089; H05B 33/0854; H05B 33/0812;
(Continued)

(56) References Cited

U.S. PATENT DOCUMENTS 2,899,541 A 8/1957 De Mauro
D185,410 S 6/1959 Bodian
(Continued)

FOREIGN PATENT DOCUMENTS

CN 1873908 A 12/2006
JP 2005-073133 3/1993
(Continued)

OTHER PUBLICATIONS

"Enlightened Energy Management System," ETCC Open Forum, 13 pp. (Jul. 24, 2012).
(Continued)

*Primary Examiner* — Alexander H Taningco
*Assistant Examiner* — Renan Luque
(74) *Attorney, Agent, or Firm* — Cooley LLP

(57) ABSTRACT

Light-emitting diodes (LEDs) generate light more efficiently than high-intensity discharge lamps or high-intensity fluorescent lamps. Driving a series of LEDs with a constant-voltage primary supply and a low-voltage LED driver keeps efficiency high. Unfortunately, LED forward voltage varies as a function of temperature: at low temperature, the forward voltage rises. Placing the LEDs in series magnifies the forward voltage increases. This makes it difficult to drive a series of LEDs at low temperature with a constant-voltage supply because the forward voltage can exceed the power supply voltage. To account for this behavior, an exemplary LED lighting fixture includes a "bypass" circuit that, when engaged, effectively removes at least one LED from each series string of LEDs to bring the total forward voltage below the power supply voltage. The low-voltage driver circuit monitors temperature, and engages the "bypass" circuit when necessary to ensure that DC voltage is not exceeded.

8 Claims, 13 Drawing Sheets

Related U.S. Application Data

(60) Provisional application No. 61/817,671, filed on Apr. 30, 2013.

(52) U.S. Cl.
CPC ..... *H05B 33/0827* (2013.01); *H05B 33/0845* (2013.01); *H05B 33/0851* (2013.01)

(58) Field of Classification Search
CPC ..... H05B 33/0851; H05B 33/0845; H05B 33/0827
See application file for complete search history.

(56) References Cited

U.S. PATENT DOCUMENTS

D191,530 S 10/1961 Zurawski
D200,548 S 3/1965 Reeves
4,194,181 A 3/1980 Brundage
4,217,646 A 8/1980 Caltagirone et al.
4,277,691 A 7/1981 Lunn
4,298,922 A 11/1981 Hardwick
4,558,275 A 12/1985 Borowy et al.
4,755,920 A 7/1988 Tinley
4,772,825 A 9/1988 Tabor et al.
4,780,731 A 10/1988 Creutzmann et al.
D300,471 S 3/1989 Szymanek
4,873,469 A 10/1989 Young et al.
5,055,985 A 10/1991 Fabbri
5,144,222 A 9/1992 Herbert
5,323,334 A 6/1994 Meyers et al.
5,430,356 A 7/1995 Ference et al.
5,455,487 A 10/1995 Mix et al.
5,521,852 A 5/1996 Hibbs et al.
5,521,853 A 5/1996 Hibbs et al.
D374,301 S 10/1996 Kleffman
5,566,084 A 10/1996 Cmar
5,572,237 A 11/1996 Crooks et al.
5,572,239 A 11/1996 Jaegar
5,640,792 A 6/1997 Smith et al.
5,655,833 A 8/1997 Raczynski
5,668,446 A 9/1997 Baker
5,739,639 A 4/1998 Johnson
5,753,983 A 5/1998 Dickie et al.
5,764,146 A 6/1998 Baldwin et al.
5,895,986 A 4/1999 Walters et al.
5,914,865 A 6/1999 Barbehenn et al.
5,945,993 A 8/1999 Fleischmann
5,971,597 A 10/1999 Baldwin et al.
6,016,038 A 1/2000 Mueller et al.
6,025,679 A 2/2000 Harper et al.
6,028,396 A 2/2000 Morrissey, Jr. et al.
6,028,597 A 2/2000 Ryan et al.
6,035,266 A 3/2000 Williams et al.
6,092,913 A 7/2000 Edwards, Jr.
6,097,419 A 8/2000 Morris et al.
6,113,137 A 9/2000 Mizutani et al.
6,118,230 A 9/2000 Fleischmann
6,150,774 A 11/2000 Mueller et al.
6,151,529 A 11/2000 Batko
6,160,359 A 12/2000 Fleischmann
6,166,496 A 12/2000 Lys et al.
6,211,626 B1 4/2001 Lys et al.
6,257,735 B1 7/2001 Baar
D447,266 S 8/2001 Verfuerth
6,292,901 B1 9/2001 Lys et al.
6,340,868 B1 1/2002 Lys et al.
6,359,555 B1 3/2002 Williams
6,370,489 B1 4/2002 Williams et al.
D457,667 S 5/2002 Piepgras et al.
D457,669 S 5/2002 Piepgras et al.
D457,974 S 5/2002 Piepgras et al.
6,384,722 B1 5/2002 Williams
6,388,399 B1 5/2002 Eckel et al.
6,393,381 B1 5/2002 Williams et al.
D458,395 S 6/2002 Piepgras et al.
D460,735 S 7/2002 Verfuerth
6,415,205 B1 7/2002 Myron et al.
6,415,245 B2 7/2002 Williams et al.
6,428,183 B1 8/2002 McAlpin
D463,059 S 9/2002 Verfuerth
D463,610 S 9/2002 Piepgras et al.
6,452,339 B1 9/2002 Morrissey et al.
6,452,340 B1 9/2002 Morrissey, Jr. et al.
6,456,960 B1 9/2002 Williams et al.
6,459,919 B1 10/2002 Lys et al.
6,466,190 B1 10/2002 Evoy
6,467,933 B2 10/2002 Baar
6,486,790 B1 11/2002 Perlo et al.
D468,035 S 12/2002 Blanc et al.
6,491,412 B1 12/2002 Bowman et al.
6,517,218 B2 2/2003 Hochstein
6,528,954 B1 3/2003 Lys et al.
6,548,967 B1 4/2003 Dowling et al.
6,577,080 B2 6/2003 Lys et al.
6,585,396 B1 7/2003 Verfuerth
6,604,062 B2 8/2003 Williams et al.
6,608,453 B2 8/2003 Morgan et al.
D479,826 S 9/2003 Verfuerth et al.
6,624,597 B2 9/2003 Dowling et al.
6,641,284 B2 11/2003 Stopa et al.
6,652,119 B1 11/2003 Barton
D483,332 S 12/2003 Verfuerth
6,710,588 B1 3/2004 Verfuerth et al.
6,714,895 B2 3/2004 Williams et al.
6,717,376 B2 4/2004 Lys et al.
6,720,745 B2 4/2004 Lys et al.
6,724,180 B1 4/2004 Verfuerth et al.
D491,678 S 6/2004 Piepgras
D492,042 S 6/2004 Piepgras
6,746,274 B1 6/2004 Verfuerth
6,748,299 B1 6/2004 Motoyama
6,758,580 B1 7/2004 Verfuerth
D494,700 S 8/2004 Hartman et al.
6,774,584 B2 8/2004 Lys et al.
6,774,619 B1 8/2004 Verfuerth et al.
6,777,891 B2 8/2004 Lys et al.
6,781,329 B2 8/2004 Mueller et al.
6,788,011 B2 9/2004 Mueller et al.
6,791,458 B2 9/2004 Baldwin
6,798,341 B1 9/2004 Eckel et al.
6,801,003 B2 10/2004 Schanberger et al.
6,806,659 B1 10/2004 Mueller et al.
6,807,516 B2 10/2004 Williams et al.
6,841,944 B2 1/2005 Morrissey et al.
6,869,204 B2 3/2005 Morgan et al.
6,883,929 B2 4/2005 Dowling
6,888,322 B2 5/2005 Dowling et al.
6,892,168 B2 5/2005 Williams et al.
6,909,921 B1 6/2005 Bilger
6,933,627 B2 8/2005 Wilhelm
6,936,978 B2 8/2005 Morgan et al.
6,964,502 B1 11/2005 Verfuerth
6,965,205 B2 11/2005 Piepgras et al.
6,967,448 B2 11/2005 Morgan et al.
6,969,954 B2 11/2005 Lys
6,975,079 B2 12/2005 Lys et al.
7,002,546 B1 2/2006 Stuppi et al.
D518,218 S 3/2006 Roberge et al.
7,014,336 B1 3/2006 Ducharme et al.
7,019,276 B2 3/2006 Cloutier et al.
7,031,920 B2 4/2006 Dowling et al.
7,038,398 B1 5/2006 Lys et al.
7,038,399 B2 5/2006 Lys et al.
7,042,172 B2 5/2006 Dowling et al.
7,062,360 B2 6/2006 Fairlie et al.
7,064,498 B2 6/2006 Dowling et al.
7,093,952 B2 8/2006 Ono et al.
7,113,541 B1 9/2006 Lys et al.
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,160,140 B1 1/2007 Mrakovich et al.

(56) References Cited

U.S. PATENT DOCUMENTS

| | | | |
|---|---|---|---|
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,178,941 | B2 | 2/2007 | Roberge et al. |
| 7,180,252 | B2 | 2/2007 | Lys et al. |
| D538,462 | S | 3/2007 | Verfuerth et al. |
| 7,186,003 | B2 | 3/2007 | Dowling et al. |
| 7,187,141 | B2 | 3/2007 | Mueller et al. |
| 7,190,121 | B2 | 3/2007 | Rose et al. |
| 7,199,531 | B2 | 4/2007 | Loughrey |
| 7,202,613 | B2 | 4/2007 | Morgan et al. |
| 7,204,622 | B2 | 4/2007 | Dowling et al. |
| 7,220,015 | B2 | 5/2007 | Dowling |
| 7,220,018 | B2 | 5/2007 | Crabb et al. |
| 7,221,104 | B2 | 5/2007 | Lys et al. |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,236,366 | B2 | 6/2007 | Chen |
| 7,242,152 | B2 | 7/2007 | Dowling et al. |
| 7,248,239 | B2 | 7/2007 | Dowling et al. |
| D548,868 | S | 8/2007 | Roberge et al. |
| 7,253,566 | B2 | 8/2007 | Lys et al. |
| 7,255,457 | B2 | 8/2007 | Ducharme et al. |
| 7,256,554 | B2 | 8/2007 | Lys |
| 7,256,556 | B2 | 8/2007 | Lane et al. |
| 7,274,160 | B2 | 9/2007 | Mueller et al. |
| 7,274,975 | B2 | 9/2007 | Miller |
| 7,300,192 | B2 | 11/2007 | Mueller et al. |
| D557,817 | S | 12/2007 | Verfuerth |
| 7,303,300 | B2 | 12/2007 | Dowling et al. |
| 7,308,296 | B2 | 12/2007 | Lys et al. |
| 7,309,965 | B2 | 12/2007 | Dowling et al. |
| 7,311,423 | B2 | 12/2007 | Frecska et al. |
| D560,469 | S | 1/2008 | Bartol et al. |
| D562,494 | S | 2/2008 | Piepgras |
| 7,333,903 | B2 | 2/2008 | Walters et al. |
| 7,344,279 | B2 | 3/2008 | Mueller et al. |
| 7,344,296 | B2 | 3/2008 | Matsui et al. |
| 7,348,736 | B2 | 3/2008 | Piepgras et al. |
| D566,323 | S | 4/2008 | Piepgras et al. |
| 7,350,936 | B2 | 4/2008 | Ducharme et al. |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,354,172 | B2 | 4/2008 | Chemel et al. |
| 7,358,679 | B2 | 4/2008 | Lys et al. |
| 7,358,929 | B2 | 4/2008 | Mueller et al. |
| 7,385,359 | B2 | 6/2008 | Dowling et al. |
| 7,387,405 | B2 | 6/2008 | Ducharme et al. |
| 7,391,335 | B2 | 6/2008 | Mubaslat et al. |
| 7,401,942 | B1 | 7/2008 | Verfuerth et al. |
| 7,411,489 | B1 | 8/2008 | Elwell et al. |
| 7,427,840 | B2 | 9/2008 | Morgan et al. |
| 7,445,354 | B2 | 11/2008 | Aoki et al. |
| 7,453,217 | B2 | 11/2008 | Lys et al. |
| 7,470,055 | B2 | 12/2008 | Hacker et al. |
| 7,482,565 | B2 | 1/2009 | Morgan et al. |
| 7,482,764 | B2 | 1/2009 | Morgan et al. |
| 7,495,671 | B2 | 2/2009 | Chemel et al. |
| 7,501,768 | B2 | 3/2009 | Lane et al. |
| 7,502,034 | B2 | 3/2009 | Chemel et al. |
| 7,506,993 | B2 | 3/2009 | Kain et al. |
| 7,507,001 | B2 | 3/2009 | Kit |
| 7,518,319 | B2 | 4/2009 | Konno et al. |
| 7,520,634 | B2 | 4/2009 | Ducharme et al. |
| D592,786 | S | 5/2009 | Bisberg et al. |
| 7,529,594 | B2 | 5/2009 | Walters et al. |
| D593,697 | S | 6/2009 | Liu et al. |
| 7,543,956 | B2 | 6/2009 | Piepgras et al. |
| 7,546,167 | B2 | 6/2009 | Walters et al. |
| 7,546,168 | B2 | 6/2009 | Walters et al. |
| 7,550,931 | B2 | 6/2009 | Lys et al. |
| 7,550,935 | B2 | 6/2009 | Lys et al. |
| D595,894 | S | 7/2009 | Verfuerth et al. |
| 7,563,006 | B1 | 7/2009 | Verfuerth et al. |
| 7,571,063 | B2 | 8/2009 | Howell et al. |
| 7,572,028 | B2 | 8/2009 | Mueller et al. |
| 7,575,338 | B1 | 8/2009 | Verfuerth |
| 7,598,681 | B2 | 10/2009 | Lys et al. |
| 7,598,684 | B2 | 10/2009 | Lys et al. |
| 7,598,686 | B2 | 10/2009 | Lys et al. |
| 7,603,184 | B2 | 10/2009 | Walters et al. |
| 7,619,370 | B2 | 11/2009 | Chemel et al. |
| D606,697 | S | 12/2009 | Verfuerth et al. |
| D606,698 | S | 12/2009 | Verfuerth et al. |
| 7,628,506 | B2 | 12/2009 | Verfuerth et al. |
| 7,638,743 | B2 | 12/2009 | Bartol et al. |
| 7,642,730 | B2 | 1/2010 | Dowling et al. |
| 7,646,029 | B2 | 1/2010 | Mueller et al. |
| 7,659,674 | B2 | 2/2010 | Mueller et al. |
| 7,660,892 | B2 | 2/2010 | Choong et al. |
| 7,703,951 | B2 | 4/2010 | Piepgras et al. |
| D617,028 | S | 6/2010 | Verfuerth et al. |
| D617,029 | S | 6/2010 | Verfuerth et al. |
| 7,744,251 | B2 | 6/2010 | Liu et al. |
| 7,746,003 | B2 | 6/2010 | Verfuerth et al. |
| 7,753,568 | B2 | 7/2010 | Hu et al. |
| 7,761,260 | B2 | 7/2010 | Walters et al. |
| 7,762,861 | B2 | 7/2010 | Verfuerth et al. |
| D621,410 | S | 8/2010 | Verfuerth et al. |
| D621,411 | S | 8/2010 | Verfuerth et al. |
| 7,766,518 | B2 | 8/2010 | Piepgras et al. |
| 7,777,427 | B2 | 8/2010 | Stalker, III |
| 7,780,310 | B2 | 8/2010 | Verfuerth et al. |
| 7,783,390 | B2 | 8/2010 | Miller |
| 7,784,966 | B2 | 8/2010 | Verfuerth et al. |
| D623,340 | S | 9/2010 | Verfuerth et al. |
| 7,792,956 | B2 | 9/2010 | Choong et al. |
| 7,809,448 | B2 | 10/2010 | Lys et al. |
| 7,824,065 | B2 | 11/2010 | Maxik |
| 7,828,465 | B2 | 11/2010 | Roberge et al. |
| 7,839,017 | B2 | 11/2010 | Huizenga et al. |
| 7,839,295 | B2 | 11/2010 | Ries, II |
| 7,845,823 | B2 | 12/2010 | Mueller et al. |
| 7,852,017 | B1 | 12/2010 | Melanson |
| 7,866,847 | B2 | 1/2011 | Zheng |
| D632,006 | S | 2/2011 | Verfuerth et al. |
| D632,418 | S | 2/2011 | Bisberg et al. |
| 7,878,683 | B2 | 2/2011 | Logan et al. |
| 7,911,359 | B2 | 3/2011 | Walters et al. |
| 7,924,155 | B2 | 4/2011 | Soccoli et al. |
| 7,925,384 | B2 | 4/2011 | Huizenga et al. |
| 7,926,974 | B2 | 4/2011 | Wung et al. |
| 7,936,561 | B1 | 5/2011 | Lin |
| 7,938,558 | B2 | 5/2011 | Wilcox et al. |
| 7,959,320 | B2 | 6/2011 | Mueller et al. |
| 7,962,606 | B2 | 6/2011 | Barron et al. |
| 7,976,188 | B2 | 7/2011 | Peng |
| 7,988,335 | B2 | 8/2011 | Liu et al. |
| 7,988,341 | B2 | 8/2011 | Chen |
| 7,997,762 | B2 | 8/2011 | Wang et al. |
| 8,010,319 | B2 | 8/2011 | Walters et al. |
| 8,013,281 | B2 | 9/2011 | Morgan et al. |
| 8,025,426 | B2 | 9/2011 | Mundle et al. |
| 8,033,686 | B2 | 10/2011 | Recker et al. |
| 8,035,320 | B2 | 10/2011 | Sibert |
| 8,042,968 | B2 | 10/2011 | Boyer et al. |
| 8,052,301 | B2 | 11/2011 | Zhou et al. |
| 8,061,865 | B2 | 11/2011 | Piepgras et al. |
| 8,066,403 | B2 | 11/2011 | Sanfilippo et al. |
| 8,067,906 | B2 | 11/2011 | Null |
| D650,225 | S | 12/2011 | Bartol et al. |
| 8,070,312 | B2 | 12/2011 | Verfuerth et al. |
| 8,079,731 | B2 | 12/2011 | Lynch et al. |
| 8,080,819 | B2 | 12/2011 | Mueller et al. |
| 8,096,679 | B2 | 1/2012 | Chen et al. |
| 8,101,434 | B2 | 1/2012 | Guillien et al. |
| 8,136,958 | B2 | 3/2012 | Verfuerth et al. |
| 8,138,690 | B2 | 3/2012 | Chemel et al. |
| 8,147,267 | B2 | 4/2012 | Oster |
| RE43,456 | E | 6/2012 | Verfuerth et al. |
| 8,214,061 | B2 | 7/2012 | Westrick, Jr. et al. |

(56) References Cited

U.S. PATENT DOCUMENTS

| | | | |
|---|---|---|---|
| 8,232,745 | B2 | 7/2012 | Chemel et al. |
| 8,237,581 | B2 | 8/2012 | Ries, II |
| 8,237,582 | B2 | 8/2012 | Ries, II |
| 8,242,927 | B2 | 8/2012 | Ries, II |
| 8,260,575 | B2 | 9/2012 | Walters et al. |
| 8,265,674 | B2 | 9/2012 | Choong et al. |
| 8,275,471 | B2 | 9/2012 | Huizenga et al. |
| 8,337,043 | B2 | 12/2012 | Verfuerth et al. |
| 8,339,069 | B2 | 12/2012 | Chemel et al. |
| 8,344,660 | B2 | 1/2013 | Mohan et al. |
| 8,344,665 | B2 | 1/2013 | Verfuerth et al. |
| 8,364,325 | B2 | 1/2013 | Huizenga et al. |
| 8,368,321 | B2 | 2/2013 | Chemel et al. |
| 8,370,483 | B2 | 2/2013 | Choong et al. |
| 8,373,362 | B2 | 2/2013 | Chemel et al. |
| 8,376,583 | B2 | 2/2013 | Wang et al. |
| 8,376,600 | B2 | 2/2013 | Bartol et al. |
| 8,406,937 | B2 | 3/2013 | Verfuerth et al. |
| 8,415,897 | B2 | 4/2013 | Choong et al. |
| 8,422,401 | B1 | 4/2013 | Choong et al. |
| 8,445,826 | B2 | 5/2013 | Verfuerth |
| 8,450,670 | B2 | 5/2013 | Verfuerth et al. |
| 8,466,626 | B2 | 6/2013 | Null et al. |
| 8,476,565 | B2 | 7/2013 | Verfuerth |
| 8,531,134 | B2 | 9/2013 | Chemel et al. |
| 8,536,802 | B2 | 9/2013 | Chemel et al. |
| 8,543,249 | B2 | 9/2013 | Chemel et al. |
| 8,552,664 | B2 | 10/2013 | Chemel et al. |
| 8,586,902 | B2 | 11/2013 | Verfuerth |
| 8,593,135 | B2 | 11/2013 | Chemel et al. |
| 8,604,701 | B2 | 12/2013 | Verfuerth et al. |
| 8,610,376 | B2 | 12/2013 | Chemel et al. |
| 8,610,377 | B2 | 12/2013 | Chemel et al. |
| 8,729,833 | B2 | 5/2014 | Chemel et al. |
| 8,754,589 | B2 | 6/2014 | Chemel et al. |
| 8,755,039 | B2 | 6/2014 | Ramer et al. |
| 8,805,550 | B2 | 8/2014 | Chemel et al. |
| 8,823,277 | B2 | 9/2014 | Chemel et al. |
| 8,841,859 | B2 | 9/2014 | Chemel et al. |
| 8,866,408 | B2 | 10/2014 | Chemel et al. |
| 8,954,170 | B2 | 2/2015 | Chemel et al. |
| 9,014,829 | B2 | 4/2015 | Chemel et al. |
| 9,072,133 | B2 | 6/2015 | Chemel et al. |
| 9,125,254 | B2 | 9/2015 | Chemel et al. |
| 9,241,392 | B2 | 1/2016 | Chemel et al. |
| 9,519,426 | B2 | 12/2016 | Iyengar |
| 2001/0028227 | A1 | 10/2001 | Lys et al. |
| 2001/0055965 | A1 | 12/2001 | Delp et al. |
| 2002/0032535 | A1 | 3/2002 | Alexander et al. |
| 2002/0036430 | A1 | 3/2002 | Welches et al. |
| 2002/0038157 | A1 | 3/2002 | Dowling et al. |
| 2002/0047628 | A1 | 4/2002 | Morgan et al. |
| 2002/0048169 | A1 | 4/2002 | Dowling et al. |
| 2002/0070688 | A1 | 6/2002 | Dowling et al. |
| 2002/0074559 | A1 | 6/2002 | Dowling et al. |
| 2002/0078221 | A1 | 6/2002 | Blackwell et al. |
| 2002/0101197 | A1 | 8/2002 | Lys et al. |
| 2002/0113555 | A1 | 8/2002 | Lys et al. |
| 2002/0130627 | A1 | 9/2002 | Morgan et al. |
| 2002/0133270 | A1 | 9/2002 | Hung et al. |
| 2002/0134849 | A1 | 9/2002 | Disser |
| 2002/0145394 | A1 | 10/2002 | Morgan et al. |
| 2002/0152045 | A1 | 10/2002 | Dowling et al. |
| 2002/0153851 | A1 | 10/2002 | Morgan et al. |
| 2002/0163316 | A1 | 11/2002 | Lys et al. |
| 2002/0171365 | A1 | 11/2002 | Morgan et al. |
| 2002/0171377 | A1 | 11/2002 | Mueller et al. |
| 2002/0171378 | A1 | 11/2002 | Morgan et al. |
| 2002/0175642 | A1 | 11/2002 | von Kannwurff et al. |
| 2003/0011538 | A1 | 1/2003 | Lys et al. |
| 2003/0057886 | A1 | 3/2003 | Lys et al. |
| 2003/0057887 | A1 | 3/2003 | Dowling et al. |
| 2003/0057888 | A1 | 3/2003 | Archenhold et al. |
| 2003/0057890 | A1 | 3/2003 | Lys et al. |
| 2003/0063462 | A1 | 4/2003 | Shimizu et al. |
| 2003/0076056 | A1 | 4/2003 | Schuurmans |
| 2003/0076281 | A1 | 4/2003 | Morgan et al. |
| 2003/0097309 | A1 | 5/2003 | Gibler et al. |
| 2003/0100837 | A1 | 5/2003 | Lys et al. |
| 2003/0100998 | A2 | 5/2003 | Brunner et al. |
| 2003/0102675 | A1 | 6/2003 | Noethlichs |
| 2003/0123705 | A1 | 7/2003 | Stam et al. |
| 2003/0123706 | A1 | 7/2003 | Stam et al. |
| 2003/0133292 | A1 | 7/2003 | Mueller et al. |
| 2003/0137258 | A1 | 7/2003 | Piepgras et al. |
| 2003/0206411 | A9 | 11/2003 | Dowling et al. |
| 2003/0214259 | A9 | 11/2003 | Dowling et al. |
| 2003/0216971 | A1 | 11/2003 | Sick et al. |
| 2003/0222587 | A1 | 12/2003 | Dowling et al. |
| 2003/0222603 | A1 | 12/2003 | Mogilner et al. |
| 2004/0002792 | A1 | 1/2004 | Hoffknecht |
| 2004/0036006 | A1 | 2/2004 | Dowling |
| 2004/0052076 | A1 | 3/2004 | Mueller et al. |
| 2004/0090191 | A1 | 5/2004 | Mueller et al. |
| 2004/0090787 | A1 | 5/2004 | Dowling et al. |
| 2004/0105261 | A1 | 6/2004 | Ducharme et al. |
| 2004/0105264 | A1 | 6/2004 | Spero |
| 2004/0111638 | A1 | 6/2004 | Yadav et al. |
| 2004/0113044 | A1 | 6/2004 | Ishiguchi |
| 2004/0113568 | A1 | 6/2004 | Dowling et al. |
| 2004/0119415 | A1 | 6/2004 | Lansing et al. |
| 2004/0130909 | A1 | 7/2004 | Mueller et al. |
| 2004/0141321 | A1 | 7/2004 | Dowling et al. |
| 2004/0155609 | A1 | 8/2004 | Lys et al. |
| 2004/0160199 | A1 | 8/2004 | Morgan et al. |
| 2004/0178751 | A1 | 9/2004 | Mueller et al. |
| 2004/0212320 | A1 | 10/2004 | Dowling et al. |
| 2004/0212321 | A1 | 10/2004 | Lys et al. |
| 2004/0212993 | A1 | 10/2004 | Morgan et al. |
| 2004/0240890 | A1 | 12/2004 | Lys et al. |
| 2004/0252501 | A1 | 12/2004 | Moriyama et al. |
| 2004/0257007 | A1 | 12/2004 | Lys et al. |
| 2005/0030744 | A1 | 2/2005 | Ducharme et al. |
| 2005/0035728 | A1 | 2/2005 | Schanberger et al. |
| 2005/0036300 | A1 | 2/2005 | Dowling et al. |
| 2005/0040774 | A1 | 2/2005 | Mueller et al. |
| 2005/0041161 | A1 | 2/2005 | Dowling et al. |
| 2005/0041424 | A1 | 2/2005 | Ducharme |
| 2005/0044617 | A1 | 3/2005 | Mueller et al. |
| 2005/0047132 | A1 | 3/2005 | Dowling et al. |
| 2005/0047134 | A1 | 3/2005 | Mueller et al. |
| 2005/0062440 | A1 | 3/2005 | Lys et al. |
| 2005/0063194 | A1 | 3/2005 | Lys et al. |
| 2005/0099796 | A1 | 5/2005 | Magee |
| 2005/0099824 | A1 | 5/2005 | Dowling et al. |
| 2005/0116667 | A1 | 6/2005 | Mueller et al. |
| 2005/0125083 | A1 | 6/2005 | Kiko |
| 2005/0128751 | A1 | 6/2005 | Roberge et al. |
| 2005/0151489 | A1 | 7/2005 | Lys et al. |
| 2005/0162101 | A1 | 7/2005 | Leong et al. |
| 2005/0174473 | A1 | 8/2005 | Morgan et al. |
| 2005/0213352 | A1 | 9/2005 | Lys |
| 2005/0213353 | A1 | 9/2005 | Lys |
| 2005/0218838 | A1 | 10/2005 | Lys |
| 2005/0218870 | A1 | 10/2005 | Lys |
| 2005/0219872 | A1 | 10/2005 | Lys |
| 2005/0231133 | A1 | 10/2005 | Lys |
| 2005/0236029 | A1 | 10/2005 | Dowling |
| 2005/0236998 | A1 | 10/2005 | Mueller et al. |
| 2005/0248299 | A1 | 11/2005 | Chemel et al. |
| 2005/0253533 | A1 | 11/2005 | Lys et al. |
| 2005/0258765 | A1 | 11/2005 | Rodriguez et al. |
| 2005/0275626 | A1 | 12/2005 | Mueller et al. |
| 2005/0276053 | A1 | 12/2005 | Nortrup et al. |
| 2005/0285547 | A1 | 12/2005 | Piepgras et al. |
| 2006/0002110 | A1 | 1/2006 | Dowling et al. |
| 2006/0012987 | A9 | 1/2006 | Ducharme et al. |
| 2006/0022214 | A1 | 2/2006 | Morgan et al. |
| 2006/0038511 | A1 | 2/2006 | Tagawa |
| 2006/0050509 | A9 | 3/2006 | Dowling et al. |
| 2006/0076908 | A1 | 4/2006 | Morgan et al. |
| 2006/0087843 | A1 | 4/2006 | Setomoto et al. |
| 2006/0098077 | A1 | 5/2006 | Dowling |
| 2006/0104058 | A1 | 5/2006 | Chemel et al. |

(56) References Cited

U.S. PATENT DOCUMENTS

2006/0106762 A1 5/2006 Caracas et al.
2006/0108935 A1 5/2006 Stevn
2006/0109649 A1 5/2006 Ducharme et al.
2006/0125426 A1 6/2006 Veskovic et al.
2006/0132061 A1 6/2006 McCormick et al.
2006/0146531 A1 7/2006 Reo et al.
2006/0152172 A9 7/2006 Mueller et al.
2006/0158881 A1 7/2006 Dowling
2006/0160199 A1 7/2006 DiCosimo et al.
2006/0170376 A1 8/2006 Piepgras et al.
2006/0181878 A1 8/2006 Burkholder
2006/0198128 A1 9/2006 Piepgras et al.
2006/0208667 A1 9/2006 Lys et al.
2006/0221606 A1 10/2006 Dowling
2006/0245174 A1 11/2006 Ashdown et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0273741 A1 12/2006 Stalker, III
2006/0276938 A1 12/2006 Miller
2006/0285325 A1 12/2006 Ducharme et al.
2007/0021946 A1 1/2007 Williams et al.
2007/0030716 A1 2/2007 Manolescu
2007/0032990 A1 2/2007 Williams et al.
2007/0040513 A1 2/2007 Cleland et al.
2007/0045407 A1 3/2007 Paul
2007/0047227 A1 3/2007 Ducharme
2007/0064425 A1 3/2007 Frecska et al.
2007/0086754 A1 4/2007 Lys et al.
2007/0086912 A1 4/2007 Dowling et al.
2007/0115658 A1 5/2007 Mueller et al.
2007/0115665 A1 5/2007 Mueller et al.
2007/0143046 A1 6/2007 Budike, Jr.
2007/0145915 A1 6/2007 Roberge et al.
2007/0152797 A1 7/2007 Chemel et al.
2007/0153514 A1 7/2007 Dowling et al.
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0206375 A1 9/2007 Piepgras et al.
2007/0211463 A1 9/2007 Chevalier et al.
2007/0217196 A1 9/2007 Shaner
2007/0228999 A1 10/2007 Kit
2007/0229250 A1 10/2007 Recker et al.
2007/0236156 A1 10/2007 Lys et al.
2007/0237284 A1 10/2007 Lys et al.
2007/0258231 A1 11/2007 Koerner et al.
2007/0258240 A1 11/2007 Ducharme et al.
2007/0263379 A1 11/2007 Dowling
2007/0267978 A1 11/2007 Shteynberg et al.
2007/0273307 A1 11/2007 Westrick et al.
2007/0291483 A1 12/2007 Lys
2008/0001071 A1 1/2008 Lee et al.
2008/0007943 A1 1/2008 Verfuerth et al.
2008/0007944 A1 1/2008 Verfuerth et al.
2008/0012502 A1 1/2008 Lys
2008/0012506 A1 1/2008 Mueller et al.
2008/0030149 A1 2/2008 Callahan
2008/0074059 A1 3/2008 Ahmed
2008/0079568 A1 4/2008 Primous et al.
2008/0089060 A1 4/2008 Kondo et al.
2008/0140231 A1 6/2008 Blackwell et al.
2008/0158878 A1 7/2008 Van Laanen et al.
2008/0164826 A1 7/2008 Lys
2008/0164827 A1 7/2008 Lys
2008/0164854 A1 7/2008 Lys
2008/0170371 A1 7/2008 Lai
2008/0180015 A1 7/2008 Wu et al.
2008/0183081 A1 7/2008 Lys et al.
2008/0183307 A1 7/2008 Clayton et al.
2008/0183316 A1 7/2008 Clayton
2008/0195561 A1 8/2008 Herzig
2008/0204268 A1 8/2008 Dowling et al.
2008/0208651 A1 8/2008 Johnston et al.
2008/0215391 A1 9/2008 Dowling et al.
2008/0246415 A1 10/2008 Chitta et al.
2008/0265799 A1 10/2008 Sibert
2008/0272934 A1 11/2008 Wang et al.
2008/0275802 A1 11/2008 Verfuerth et al.
2008/0278941 A1 11/2008 Logan et al.
2008/0310850 A1 12/2008 Pederson et al.
2009/0000217 A1 1/2009 Verfuerth et al.
2009/0009989 A1 1/2009 Verfuerth et al.
2009/0014625 A1 1/2009 Bartol et al.
2009/0018673 A1 1/2009 Dushane et al.
2009/0021955 A1 1/2009 Kuang et al.
2009/0027932 A1 1/2009 Haines et al.
2009/0034263 A1 2/2009 Stenback et al.
2009/0050908 A1 2/2009 Yuan et al.
2009/0051506 A1 2/2009 Hicksted et al.
2009/0059603 A1 3/2009 Recker et al.
2009/0059915 A1 3/2009 Baker
2009/0066266 A1 3/2009 Jungwirth et al.
2009/0076790 A1 3/2009 Fein et al.
2009/0085494 A1 4/2009 Summerland
2009/0085500 A1 4/2009 Zampini et al.
2009/0122571 A1 5/2009 Simmons et al.
2009/0147507 A1 6/2009 Verfuerth et al.
2009/0160364 A1 6/2009 Ackermann et al.
2009/0189535 A1 7/2009 Verfuerth et al.
2009/0193217 A1 7/2009 Korecki et al.
2009/0243517 A1 10/2009 Verfuerth et al.
2009/0248217 A1 10/2009 Verfuerth et al.
2009/0267540 A1 10/2009 Chemel et al.
2009/0278472 A1 11/2009 Mills et al.
2009/0278479 A1 11/2009 Platner et al.
2009/0284184 A1 11/2009 Valois et al.
2009/0299527 A1 12/2009 Huizenga et al.
2009/0299811 A1 12/2009 Verfuerth et al.
2009/0303722 A1 12/2009 Verfuerth et al.
2009/0315485 A1 12/2009 Verfuerth et al.
2009/0323347 A1 12/2009 Zhang et al.
2010/0026479 A1 2/2010 Tran
2010/0034386 A1 2/2010 Choong et al.
2010/0052574 A1 3/2010 Blakeley
2010/0061088 A1 3/2010 Bartol et al.
2010/0109536 A1 5/2010 Jung et al.
2010/0124376 A1 5/2010 Thind
2010/0127634 A1 5/2010 Dowling et al.
2010/0134051 A1 6/2010 Huizenga et al.
2010/0135186 A1 6/2010 Choong et al.
2010/0148689 A1 6/2010 Morgan et al.
2010/0169249 A1 7/2010 Jhala et al.
2010/0171145 A1 7/2010 Morgan et al.
2010/0171442 A1 7/2010 Draper et al.
2010/0185339 A1 7/2010 Huizenga et al.
2010/0201267 A1 8/2010 Bourquin et al.
2010/0204841 A1 8/2010 Chemel et al.
2010/0207534 A1 8/2010 Dowling et al.
2010/0211443 A1 8/2010 Carrel et al.
2010/0246168 A1 9/2010 Verfuerth et al.
2010/0246172 A1 9/2010 Liu
2010/0253499 A1 10/2010 Haab et al.
2010/0259931 A1 10/2010 Chemel et al.
2010/0262313 A1 10/2010 Chambers et al.
2010/0264834 A1 10/2010 Gaines et al.
2010/0264846 A1 10/2010 Chemel et al.
2010/0270933 A1 10/2010 Chemel et al.
2010/0283605 A1 11/2010 Nevins
2010/0295473 A1 11/2010 Chemel et al.
2010/0295474 A1 11/2010 Chemel et al.
2010/0295475 A1 11/2010 Chemel et al.
2010/0295482 A1 11/2010 Chemel et al.
2010/0296285 A1 11/2010 Chemel et al.
2010/0301768 A1 12/2010 Chemel et al.
2010/0301769 A1 12/2010 Chemel et al.
2010/0301770 A1 12/2010 Chemel et al.
2010/0301771 A1 12/2010 Chemel et al.
2010/0301773 A1 12/2010 Chemel et al.
2010/0301774 A1 12/2010 Chemel et al.
2010/0301834 A1 12/2010 Chemel et al.
2010/0302779 A1 12/2010 Chemel et al.

(56) References Cited

U.S. PATENT DOCUMENTS

2010/0307075 A1 12/2010 Zampini et al.
2010/0308736 A1 12/2010 Hung et al.
2010/0327766 A1 12/2010 Recker et al.
2011/0001436 A1 1/2011 Chemel et al.
2011/0001438 A1 1/2011 Chemel et al.
2011/0033632 A1 2/2011 Vance et al.
2011/0035404 A1 2/2011 Morgan et al.
2011/0038148 A1 2/2011 Pyle
2011/0043124 A1 2/2011 Johnston et al.
2011/0057581 A1 3/2011 Ashar et al.
2011/0060701 A1 3/2011 Verfuerth et al.
2011/0068702 A1 3/2011 Van De Ven et al.
2011/0084608 A1 4/2011 Lin et al.
2011/0090684 A1 4/2011 Logan et al.
2011/0102052 A1 5/2011 Billingsley et al.
2011/0118890 A1 5/2011 Parsons
2011/0133655 A1 6/2011 Recker et al.
2011/0140611 A1 6/2011 Elek et al.
2011/0140612 A1 6/2011 Mohan et al.
2011/0146669 A1 6/2011 Bartol et al.
2011/0172844 A1 7/2011 Choong et al.
2011/0198977 A1 8/2011 VanderSluis
2011/0204820 A1 8/2011 Tikkanen et al.
2011/0215736 A1 9/2011 Horbst et al.
2011/0216538 A1 9/2011 Logan et al.
2011/0235317 A1 9/2011 Verfuerth et al.
2011/0248171 A1 10/2011 Rueger et al.
2011/0254466 A1 10/2011 Jackson et al.
2011/0279063 A1 11/2011 Wang et al.
2011/0279248 A1 11/2011 Ogawa
2012/0007511 A1 1/2012 Choong et al.
2012/0032599 A1 2/2012 Mohan et al.
2012/0037725 A1 2/2012 Verfuerth
2012/0038281 A1 2/2012 Verfuerth
2012/0038490 A1 2/2012 Verfuerth
2012/0040606 A1 2/2012 Verfuerth
2012/0044350 A1 2/2012 Verfuerth
2012/0044670 A1 2/2012 Piepgras et al.
2012/0058663 A1 3/2012 Oster
2012/0062125 A1 3/2012 Mohan et al.
2012/0080944 A1 4/2012 Recker et al.
2012/0081906 A1 4/2012 Verfuerth et al.
2012/0086363 A1 4/2012 Golding et al.
2012/0098439 A1 4/2012 Recker et al.
2012/0112654 A1 5/2012 Choong et al.
2012/0112667 A1 5/2012 Mohan et al.
2012/0130544 A1 5/2012 Mohan et al.
2012/0143357 A1 6/2012 Chemel et al.
2012/0153844 A1 6/2012 Chobot
2012/0167957 A1 7/2012 Verfuerth et al.
2012/0182729 A1 7/2012 Verfuerth et al.
2012/0203601 A1 8/2012 Verfuerth et al.
2012/0209755 A1 8/2012 Verfuerth et al.
2012/0229049 A1 9/2012 Mohan et al.
2012/0233045 A1 9/2012 Verfuerth et al.
2012/0235579 A1 9/2012 Chemel et al.
2012/0262074 A1* 10/2012 Wang ..... H05B 33/083 315/186
2012/0274222 A1 11/2012 Verfuerth et al.
2012/0286673 A1 11/2012 Holland et al.
2012/0299485 A1 11/2012 Mohan et al.
2012/0326608 A1 12/2012 Mohan et al.
2013/0006437 A1 1/2013 Verfuerth et al.
2013/0020949 A1 1/2013 Mohan et al.
2013/0033183 A1 2/2013 Verfuerth et al.
2013/0063042 A1 3/2013 Bora et al.
2013/0069542 A1 3/2013 Curasi et al.
2013/0069543 A1 3/2013 Mohan et al.
2013/0088168 A1 4/2013 Mohan et al.
2013/0093323 A1 4/2013 Radermacher
2013/0094230 A1 4/2013 Verfuerth et al.
2013/0131882 A1 5/2013 Verfuerth et al.
2013/0141904 A1 6/2013 Verfuerth et al.
2013/0169185 A1 7/2013 Dai et al.
2013/0176401 A1 7/2013 Monari et al.
2013/0193857 A1 8/2013 Tlachac et al.
2013/0229795 A1 9/2013 Wang et al.
2013/0257292 A1 10/2013 Verfuerth et al.
2013/0293117 A1 11/2013 Verfuerth
2013/0293877 A1 11/2013 Ramer et al.
2013/0308325 A1 11/2013 Verfuerth et al.
2014/0028199 A1 1/2014 Chemel et al.
2014/0117852 A1 5/2014 Zhai et al.
2014/0252961 A1 9/2014 Ramer et al.
2014/0285090 A1 9/2014 Chemel et al.
2014/0285095 A1 9/2014 Chemel et al.
2014/0292208 A1 10/2014 Chemel et al.
2014/0293605 A1 10/2014 Chemel et al.
2014/0333222 A1 11/2014 Chemel et al.
2014/0375206 A1 12/2014 Holland et al.
2015/0008827 A1 1/2015 Carrigan et al.
2015/0008828 A1 1/2015 Carrigan et al.
2015/0061511 A1 3/2015 Chemel et al.
2015/0184842 A1 7/2015 Chemel et al.
2016/0014856 A1* 1/2016 Wacheux ..... H05B 33/083 315/77
2016/0360594 A1 12/2016 Chemel et al.
2016/0374166 A1* 12/2016 Chen ..... H05B 33/083
2017/0019970 A1 1/2017 Chemel et al.
2017/0027045 A1 1/2017 Chemel et al.
2017/0042001 A1 2/2017 Chemel et al.
2017/0086279 A1 3/2017 Chemel et al.

FOREIGN PATENT DOCUMENTS

JP 2006-106762 4/2006
JP 2007-045407 A 2/2007
WO WO 96/20369 7/1996
WO WO 98/34206 A1 8/1998
WO WO 2007/003038 A1 1/2007
WO WO 2007/116332 A2 10/2007
WO WO 2009/003279 1/2009
WO WO 2009/129232 A1 10/2009
WO WO 2010/116283 A2 10/2010
WO WO 2012/061709 A1 5/2012
WO WO 2012/129243 A1 9/2012
WO WO 2013/067389 A1 5/2013
WO WO 2013/142292 A1 9/2013

OTHER PUBLICATIONS

Office Action in U.S. Appl. No. 12/817,425, dated Mar. 23, 2016, 9 pages.
Office Action in U.S. Appl. No. 14/294,081, dated Mar. 14, 2016, 20 pages.
Examination Report in European Patent Application No. 09732558.3, dated Apr. 19, 2016, 5 pages.
Second Office Action in Chinese Patent Application No. 201380026132.5, dated Apr. 20, 2016, 6 pages (w/English translation).
Examination Report in Australian Patent Application No. 2015255250, dated Jun. 1, 2016, 3 pages.
Final Office Action in U.S. Appl. No. 13/425,295, dated Mar. 7, 2016, 18 pages.
Supplementary European Search Report dated Nov. 28, 2016 in European Application No. EP 14 79 1232, 6 pages.
International Search Report and Written Opinion dated Oct. 14, 2016 in International Application No. PCT/US2016/043893, 14 pages.
Final Office Action in U.S. Appl. No. 12/817,425 dated Dec. 15, 2016, 10 pages.
Office Action in U.S. Appl. No. 14/518,831 dated Dec. 30, 2016, 51 pp.
Communication pursuant to Article 94(3) EPC, issued by the European Patent Office for Application No. 12761180.4, dated Jan. 27, 2017, 5 pages.
Office Action issued by the Canadian Patent Office for Application No. 2721486, dated Oct. 14, 2016, 4 pages.
Notice of Acceptance issued by the Australian Patent Office for Application No. 2014218445, dated Jul. 15, 2016, 2 pages.

(56) References Cited

OTHER PUBLICATIONS

Notice of Acceptance issued by the Australian Patent Office for Application No. 2015255250, dated Jan. 24, 2017, 3 pages.
Notification of Fulfilling of Registration Formality issued by the Patent Office of the People's Republic of China for Application No. 201380026132.5, dated Aug. 3, 2016 (English Translation), 2 pages.
Notice of Acceptance issued by the Australian Patent Office for Application No. 2013235436, dated Nov. 16, 2016, 2 pages.
Advisory Action in U.S. Appl. No. 12/831,358, dated Feb. 27, 2014, 2 pages.
Albeo Technologies, C Series, http://www.albeotech.com/?site_id=1500&item_id=161711, retrieved May 18, 2011, 2 pages.
Albeo Technologies, C3 Series, http://www.albeotech.com/?site_id=1500&item_id=173338, retrieved May 18, 2011, 2 pages.
Albeo Technologies, S Series, http://www.albeotech.com/?site_id=1500&item_id=161722, retrieved May 18, 2011, 2 pages.
Albeo Technologies, Surface Mounts, http://www.albeotech.com/?site_id=1500&item_id=161724, retrieved May 18, 2011, 2 pages.
Beta LED, 227 Series LED Canopy, http://www.betaled.com/us-en/TechnicalLibrary/TechnicalDocuments/227-series-canopy.aspx, retrieved May 18, 2011, 2 pages.
Beta LED, 227 Series LED Soffit, http://www.betaled.com/us-en/TechnicalLibrary/TechnicalDocuments/227-series-soffit.aspx, retrieved May 18, 2011, 2 pages.
Beta LED, 304 Series LED Interior, http://www.betaled.com/us-en/TechnicalLibrary/TechnicalDocuments/304-series-canopy.aspx, retrieved May 18, 2011, 2 pages.
Beta LED, 304 Series LED Parking Structure, http://www.betaled.com/us-en/TechnicalLibrary/TechnicalDocuments/304-series-parking.aspx, retrieved May 18, 2011, 2 pages.
Beta LED, 304 Series LED Soffit, http://www.betaled.com/us-en/TechnicalLibrary/TechnicalDocuments/304-series-soffit.aspx, retrieved May 18, 2011, 2 pages.
Beta LED, The Edge Canopy, http://www.betaled.com/us-en/TechnicalLibrary/TechnicalDocuments/TheEdgeCanopy.aspx, retrieved May 18, 2011, 2 pages.
Beta LED, The Edge LED Parking Structure, http://www.betaled.com/us-en/TechnicalLibrary/TechnicalDocuments/TheEdgeParking.aspx, retrieved May 18, 2011, 2 pages.
Color Kinetics, eW Cove EC Powercore line, http://www.colorkinetics.com/support/datasheets/eW_Cove_EC_Powercore_2700K_12in_SpecSheet.pdf, retrieved May 18, 2011, 2 pages.
Color Kinetics, eW Cove MX Powercore line, http://www.colorkinetics.com/support/datasheets/eW_Cove_MX_Powercore_2700K_Wide_Beam_Angle_SpecSheet.pdf, retrieved May 18, 2011, 2 pages.
Color Kinetics, eW Cove QLX Powercore line, http://www.colorkinetics.com/support/datasheets/eW_Cove_QLX_Powercore_6in_110degreex110degree.pdf, retrieved May 18, 2011, 2 pages.
Color Kinetics, eW Fuse Powercore line, http://www.colorkinetics.com/support/datasheets/eW_Fuse_Powercore_2700K_10degree_x_60degree.pdf, retrieved May 18, 2011, 2 pages.
Color Kinetics, eW Graze Powercore line, http://www.colorkinetics.com/support/datasheets/eW_Graze_Powercore_SpecSheet_2700K_10x60.pdf, retrieved May 18, 2011, 2 pages.
Examination Report in Australian Patent Application No. 2009236311, dated May 10, 2013, 3 pages.
Examination Report in Australian Patent Application No. 2011323165, dated Aug. 22, 2014, 3 pages.
Examination Report in Australian Patent Application No. 2012230991, dated Nov. 18, 2014, 3 pages.
Examination Report in Australian Patent Application No. 2012332206, dated Feb. 12, 2015, 3 pages.
Extended European Report and Opinion for European Appln No. EP 09732558.3, dated Aug. 23, 2012, 8 pages.
Extended European Report and Opinion for European Appln No. EP 12844864.4, dated Nov. 3, 2015, 8 pages.
Extended European Report and Opinion for European Patent Application No. EP 13763788.0, dated Dec. 17, 2015, 7 pages.
Final Office Action in U.S. Appl. No. 12/817,425 dated Sep. 17, 2015, 9 pages.
Final Office Action in U.S. Appl. No. 12/817,425, dated Sep. 15, 2014, 17 pages.
Final Office Action in U.S. Appl. No. 13/425,295, dated Jan. 2, 2015, 17 pages.
Final Office Action in U.S. Appl. No. 14/245,196, dated May 27, 2015, 6 pages.
Final Office Action in U.S. Appl. No. 14/267,368 dated Dec. 31, 2015, 32 pages.
Final Office Action in U.S. Appl. No. 14/294,081, dated Jun. 10, 2015, 13 pages.
Garg, Visha et al., "Smart occupancy sensors to reduce energy consumption, Energy and Buildings," vol. 32, Issue 1, Jun. 2000, pp. 81-87. ISSN 0378-7788, 10.1 016/S0378-7788(99)00040-7. (http://www.sciencedirect.com/science/article/pii/S037877889.
International Preliminary Report on Patentability in International Application No. PCT/US2012/29834, dated Sep. 24, 2013, 7 pages.
International Preliminary Report on Patentability in International Application No. PCT/US2012/063372, dated May 6, 2014, 14 pages.
International Preliminary Report on Patentability in International Application No. PCT/US2013/031790, dated Sep. 23, 2014, 10 pages.
International Preliminary Report on Patentability of PCT/US2009/040514, dated Oct. 19, 2010, 4 pages.
International Preliminary Report on Patentability of PCT/US2011/059334, dated May 7, 2013, 8 pages.
International Search Report and Written Opinion in International Application No. PCT/US2011/059334, dated Feb. 2, 2012, 11 pages.
International Search Report and Written Opinion in International Application No. PCT/US2012/063372, dated Mar. 19, 2013, 18 pages.
International Search Report and Written Opinion in International Application No. PCT/US2013/031790, dated Jun. 3, 2013, 13 pages.
International Search Report and Written Opinion in International Application No. PCT/US2014/060095, dated Jan. 29, 2015, 16 pages.
International Search Report and Written Opinion in International Application No. PCT/US2014/35990, dated Sep. 18, 2014, 11 pages.
International Search Report and Written Report in International Application No. PCT/US12/29834, dated Jul. 12, 2012, 10 pages.
International Search Report in International Application No. PCT/US2009/040514 dated Jun. 26, 2009, 4 pages.
Notice of Acceptance for Australian Patent Application No. 2012332206, dated Jan. 21, 2016, 2 pages.
Notice of Acceptance in Australian Application No. 2009236311, dated Jun. 12, 2014, 2 pages.
Notice of Acceptance in Australian Patent Application No. 2011323165, dated Apr. 10, 2015, 2 pages.
Notice of Allowance in U.S. Appl. No. 12/423,543, dated Feb. 8, 2012, 12 pages.
Notice of Allowance in U.S. Appl. No. 12/423,543, dated Apr. 11, 2012, 8 pages.
Notice of Allowance in U.S. Appl. No. 12/423,543, dated Jun. 21, 2012, 4 pages.
Notice of Allowance in U.S. Appl. No. 12/822,421, dated Mar. 1, 2013, 9 pages.
Notice of Allowance in U.S. Appl. No. 12/822,577, dated Mar. 15, 2013, 10 pages.
Notice of Allowance in U.S. Appl. No. 12/823,195, dated Oct. 27, 2011, 7 pages.
Notice of Allowance in U.S. Appl. No. 12/823,195, dated Dec. 12, 2011, 8 pages.
Notice of Allowance in U.S. Appl. No. 12/824,797 dated Nov. 9, 2012, 8 pages.

(56) References Cited

OTHER PUBLICATIONS

Notice of Allowance in U.S. Appl. No. 12/827,336, dated Oct. 2, 2013, 12 pages.
Notice of Allowance in U.S. Appl. No. 12/827,397, dated Oct. 29, 2012, 5 pages.
Notice of Allowance in U.S. Appl. No. 12/828,340, dated Nov. 21, 2012, 5 pages.
Notice of Allowance in U.S. Appl. No. 12/828,495, dated Feb. 19, 2014, 8 pages.
Notice of Allowance in U.S. Appl. No. 12/830,868, dated Mar. 25, 2013, 9 pages.
Notice of Allowance in U.S. Appl. No. 12/830,868, dated Jun. 24, 2013, 6 pages.
Notice of Allowance in U.S. Appl. No. 12/831,358, dated Aug. 29, 2014, 9 pages.
Notice of Allowance in U.S. Appl. No. 12/831,476, dated Jun. 11, 2014, 5 pages.
Notice of Allowance in U.S. Appl. No. 12/832,179, dated Aug. 1, 2014, 9 pages.
Notice of Allowance in U.S. Appl. No. 12/832,211, dated Apr. 23, 2014, 10 pages.
Notice of Allowance in U.S. Appl. No. 12/833,181, dated May 23, 2013, 18 pages.
Notice of Allowance in U.S. Appl. No. 12/833,332, dated Mar. 21, 2013, 8 pages.
Notice of Allowance in U.S. Appl. No. 13/289,492, dated Jan. 23, 2015, 10 pages.
Notice of Allowance in U.S. Appl. No. 13/289,492, dated Nov. 19, 2014, 9 pages.
Notice of Allowance in U.S. Appl. No. 14/045,679, dated Feb. 20, 2014, 8 pages.
Notice of Allowance in U.S. Appl. No. 14/245,196, dated Sep. 9, 2015, 8 pages.
Notice of Allowance in U.S. Appl. No. 14/245,196, dated Sep. 23, 2015, 2 pages.
Notice of Allowance in U.S. Appl. No. 14/289,601, dated Apr. 1, 2015, 9 pages.
Notice of Allowance in U.S. Appl. No. 14/289,601, dated Jun. 4 2015, 2 pages.
Notice of Allowance in U.S. Appl. No. 14/294,082, dated May 19, 2015, 8 pages.
Office Action in Canadian Application No. 2,721,486 dated Jul. 14, 2015, 4 pages.
Office Action in U.S. Appl. No. 13/425,295, dated Jun. 10, 2014, 12 pages.
Office Action in U.S. Appl. No. 12/423,543, dated Jun. 27, 2011, 14 pages.
Office Action in U.S. Appl. No. 12/817,425, dated Apr. 30, 2012, 18 pages.
Office Action in U.S. Appl. No. 12/817,425, dated Feb. 25, 2015, 6 pages.
Office Action in U.S. Appl. No. 12/817,425, dated Mar. 27, 2014, 16 pages.
Office Action in U.S. Appl. No. 12/817,425, dated Nov. 3, 2011, 14 pages.
Office Action in U.S. Appl. No. 12/817,425, dated Sep. 10, 2013, 15 pages.
Office Action in U.S. Appl. No. 12/822,421, dated Jan. 19, 2012, 20 pages.
Office Action in U.S. Appl. No. 12/822,421, dated Sep. 12, 2012, 16 pages.
Office Action in U.S. Appl. No. 12/822,577, dated Apr. 2, 2012, 25 pages.
Office Action in U.S. Appl. No. 12/822,577, dated Oct. 11, 2012, 21 pages.
Office Action in U.S. Appl. No. 12/824,797, dated Jun. 29, 2012, 5 pages.
Office Action in U.S. Appl. No. 12/827,209, dated Jan. 10, 2014, 20 pages.
Office Action in U.S. Appl. No. 12/827,336, dated Jun. 13, 2013, 6 pages.
Office Action in U.S. Appl. No. 12/827,336, dated Oct. 4, 2012, 26 pages.
Office Action in U.S. Appl. No. 12/827,397, dated Jul. 11, 2012, 6 pages.
Office Action in U.S. Appl. No. 12/828,340, dated Jul. 2, 2012, 4 pages.
Office Action in U.S. Appl. No. 12/828,385, dated Mar. 19, 2013, 12 pages.
Office Action in U.S. Appl. No. 12/828,385, dated Sep. 12, 2012, 5 pages.
Office Action in U.S. Appl. No. 12/828,495, dated Dec. 12, 2012, 21 pages.
Office Action in U.S. Appl. No. 12/828,495, dated May 17, 2012, 6 pages.
Office Action in U.S. Appl. No. 12/828,495, dated Mar. 28, 2013, 22 pages.
Office Action in U.S. Appl. No. 12/828,495, dated Oct. 10, 2013, 25 pages.
Office Action in U.S. Appl. No. 12/830,868, dated Aug. 13, 2012, 26 pages.
Office Action in U.S. Appl. No. 12/830,868, dated Mar. 5, 2012, 5 pages.
Office Action in U.S. Appl. No. 12/831,358, dated Jun. 13, 2013, 7 pages.
Office Action in U.S. Appl. No. 12/831,358, dated Nov. 19, 2013, 16 pages.
Office Action in U.S. Appl. No. 12/831,476, dated Apr. 11, 2012, 7 pages.
Office Action in U.S. Appl. No. 12/831,476, dated Feb. 13, 2013, 42 pages.
Office Action in U.S. Appl. No. 12/831,476, dated Jul. 23, 2013, 42 pages.
Office Action in U.S. Appl. No. 12/831,476, dated Nov. 21, 2013, 52 pages.
Office Action in U.S. Appl. No. 12/831,476, dated Oct. 17, 2012, 36 pages.
Office Action in U.S. Appl. No. 12/832,179, dated Feb. 21, 2014, 16 pages.
Office Action in U.S. Appl. No. 12/832,179, dated Jul. 17, 2013, 15 pages.
Office Action in U.S. Appl. No. 12/832,179, dated Mar. 13, 2013, 13 pages.
Office Action in U.S. Appl. No. 12/832,179, dated Sep. 12, 2012, 5 pages.
Office Action in U.S. Appl. No. 12/832,211, dated Jun. 20, 2013, 12 pages.
Office Action in U.S. Appl. No. 12/832,211, dated Oct. 2, 2013, 13 pages.
Office Action in U.S. Appl. No. 12/832,211, dated Sep. 12, 2012, 4 pages.
Office Action in U.S. Appl. No. 12/833,181, dated Sep. 12, 2012, 5 pages.
Office Action in U.S. Appl. No. 12/833,332 dated Nov. 23, 2012, 5 pages.
Office Action in U.S. Appl. No. 12/833,332, dated Aug. 20, 2012, 5 pages.
Office Action in U.S. Appl. No. 13/289,492, dated Aug. 5, 2014, 29 pages.
Office Action in U.S. Appl. No. 13/289,492, dated Feb. 27, 2014, 28 pages.
Office Action in U.S. Appl. No. 13/425,295 dated Jun. 29, 2015, 17 pages.
Office Action in U.S. Appl. No. 14/245,196, dated Feb. 9, 2015, 13 pages.
Office Action in U.S. Appl. No. 14/267,386 dated Aug. 10, 2015, 27 pages.
Office Action in U.S. Appl. No. 14/267,386, dated Apr. 17, 2015, 30 pages.
Office Action in U.S. Appl. No. 14/289,601, dated Jan. 30, 2015, 6 pages.

(56) References Cited

OTHER PUBLICATIONS

Office Action in U.S. Appl. No. 14/294,081, dated Jan. 22, 2015, 7 pages.
Office Action in U.S. Appl. No. 14/294,082, dated Jan. 2, 2015, 10 pages.
Patent Examination Report No. 1 for Australian Patent Application No. 2013235436, dated Jan. 18, 2016, 3 pages.
Progress Report: Reducing Barriers to Use of High Efficiency Lighting Systems; Oct. 2001, (http://www.lrc.rpi.edu/researchAreas/reducingBarriers/pdf/year1FinalReport.pdf), 108 pages.
Restriction Requirement in U.S. Appl. No. 12/817,425, dated Dec. 10, 2014, 6 pages.
Restriction Requirement in U.S. Appl. No. 14/294,081, dated Oct. 9, 2014, 6 pages.
Search Report and Office Action in Chinese Patent Application No. 201380026132.5 dated Sep. 12, 2015, 34 pages (original Chinese and English translation).
Vainio, A.-M. et al., Learning and adaptive fuzzy control system for smart home, Mar. 2008, http://www.springerlink.com/content/1172k3200614qx81/fulltext.pdf, 10 pages.
Written Opinion in International Application No. PCT/US2009/040514, dated Jun. 26, 2009, 3 pages.
ZigBee Alliance "Wireless Sensors and Control Networks: Enabling New Opportunities with ZigBee", Bob Heile, Chairman, ZigBee Alliance, Dec. 2006 Powerpoint Presentation, 53 pages.
ZigBee Alliance Document No. 08006r03, Jun. 2008, ZigBee-200y Layer Pics and Stack Profile, Copyright © 1996-2008 by the ZigBee Alliance. 2400 Camino Ramon, Suite 375, San Ramon, CA 94583, USA; http://www.zigbee.org, 119 pages.
ZigBee Specification Document 053474r17, Notice of Use and Disclosure; Jan. 17, 2008 11:09 A.M., Sponsored by: ZibEe Alliance; Copyright © 2007 ZigBee Standards Organizat. All rights reserved, 602 pages.
Office Action in U.S. Appl. No. 14/960,105, dated Aug. 30, 2016, 50 pages.
Final Office Action in U.S. Appl. No. 14/294,081 dated Oct. 5, 2016, 20 pages.
Examination Report No. 1 dated Oct. 14, 2016 in Australian Patent Application No. 2015203026, 2 pages.
Office Action in U.S. Appl. No. 13/425,295, dated Mar. 7, 2016, 16 pages.
Office Action in U.S. Appl. No. 14/294,081, dated Mar. 14, 2016, 16 pages.
Search Report and Office Action in Chinese Patent Application No. 201380026132.5 dated Sep. 12, 2015, 36 pages (original Chinese and English translation).
Examination Report issued by the Canadian Patent Office for Application No. 2,830,991, dated Jul. 13, 2017, 3 pages.
Examination Report issued by the European Patent Office for Application No. 12844864.4, dated Aug. 16, 2017, 3 pages.
Examination Report No. 1 issued by the Australian Patent Office for Application No. 2016202824, dated Jul. 17, 2017, 6 pages.
Examination Report No. 1 issued by the Australian Patent Office for Application No. 2017201414, dated Jun. 6, 2017, 3 pages.
Non-Final Office Action in U.S. Appl. No. 12/817,425, dated Aug. 3, 2017, 17 pages.
Non-Final Office Action in U.S. Appl. No. 15/298,064, dated Aug. 11, 2017, 15 pages.
Notice of Allowance in U.S. Appl. No. 14/518,831, dated Aug. 21, 2017, 13 pages.
Notice of Allowance in U.S. Appl. No. 14/960,105, dated Jul. 12, 2017, 6 pages.
Office Action issued by the European Patent Office for Application No. 12 761 180.4, dated Aug. 24, 2017, 5 pages.
Communication pursuant to Article 94(3) EPC, issued by the European Patent Office for Application No. 13763788.0, dated Apr. 4, 2017, 5 pages.
European Search Report issued by the European Patent Office for Application No. 14852889.6, dated May 19, 2017, 8 pages.
Examination Report No. 1 issued by the Australian Patent Office for Application No. 2014259974, dated Apr. 3, 2017, 3 pages.
Examination Report No. 1 issued by the Australian Patent Office for Application No. 2016206250, dated May 1, 2017, 3 pages.
Examination Report No. 2 issued by the Australian Patent Office for Application No. 2015203026, dated May 16, 2017, 3 pages.
Extended European Search Report issued by the European Patent Office for Application No. 11838876.8, dated Apr. 11, 2017, 8 pages.
Non-Final Office Action in U.S. Appl. No. 14/645,548, dated May 4, 2017, 20 pages.
Non-Final Office Action in U.S. Appl. No. 15/175,725, dated Jun. 1, 2017, 14 pages.
Non-Final Office Action in U.S. Appl. No. 14/294,081, dated Jun. 15, 2017, 15 pages.
Notice of Allowance in U.S. Appl. No. 14/960,105, dated May 10, 2017, 8 pages.
Notice of Allowance in U.S. Appl. No. 14/645,548, dated Oct. 20, 2017, 12 pages.
Non-Final Office Action in U.S. Appl. No. 15/094,559, dated Sep. 28, 2017, 29 pages.
Office Action issued by the Canadian Patent Office for Application No. 2,721,486, dated Sep. 19, 2017, 3 pages.
Office Action issued by the Canadian Patent Office for Application No. 2,816,978, dated Oct. 3, 2017, 4 pages.

* cited by examiner

METHODS, APPARATUSES, AND SYSTEMS FOR OPERATING LIGHT EMITTING DIODES AT LOW TEMPERATURE

CROSS-REFERENCE TO RELATED APPLICATIONS

This application claims priority to PCT Application No. PCT/US2014/035990; filed on Apr. 30, 2014, entitled "Methods, Apparatuses, and Systems for Operating Light Emitting Diodes at Low Temperature", which is hereby incorporated herein by reference in its entirety. PCT Application No. PCT/US2014/035990 in turn claims a priority benefit of U.S. Application No. 61/817,671, filed Apr. 30, 2013, and entitled "Methods and Systems for Operating LEDs at Low Temperature," which application is hereby incorporated herein by reference in its entirety.

BACKGROUND

Compared to traditional lighting systems such as high intensity discharge (HID), high intensity fluorescent (HIF), and high pressure sodium (HPS) lightings that are used in a variety of settings, including large scale facilities such as warehouses, light emitting diodes (LEDs) provide superior performance. Some of the advantages include low energy consumption (with excellent lighting levels), fast switching, long lifetime, etc.

SUMMARY

Embodiments of the present invention include a lighting fixture that includes a plurality of light emitting diodes (LEDs) arranged in series, a constant-voltage power supply operably coupled to the LEDs, a sensor in electrical communication with the LEDs, and a bypass circuit operably coupled to the sensor. In operation, the power supply provides a constant voltage across the LEDs. The sensor measures a decrease in the LEDs' temperature; this decrease in temperature causes an increase in series voltage across the LEDs. And the bypass circuit short-circuits at least one LED in response to the increase in the series voltage so as to reduce the series voltage below the constant voltage provided by the constant-voltage power supply.

In some examples, the bypass circuit enables the short-circuited LED for a predetermined period. While the LED is re-enabled, the sensor measures a change in the LEDs' temperature, e.g., for a period of 20 ms or less. If the temperature change indicates that the series voltage remains high, the bypass circuit short-circuits the LED again. Otherwise, the bypass circuit leaves the LED enabled until the temperature drops again. The bypass circuit can also short-circuit at least one LED if the series voltage exceeds a threshold voltage.

Another embodiment comprises an apparatus for illuminating an environment at cold temperature. An exemplary apparatus includes at least one LED, a linear driver circuit operably coupled to the LED, a sensor in electrical and/or thermal communication with the at least one light emitting diode, a processor operably coupled to the to the sensor, and a switch (e.g., one or more transistors) operably coupled to the processor and to the linear driver circuit. In operation, the linear driver circuit provides a drive current to the LED. The sensor detects a variation in the drive current from a predetermined drive current caused by a decrease in temperature of the LED, e.g., based on the LED's temperature. The processor generates a drive current control signal, such a pulse-width modulated digital signal, based on at least in part on the variation measured by the sensor. And the switch controls the drive current provided to the LED by the linear drive circuit in response to the drive current control signal from the processor. The processor may also dim the LED by varying the drive current control signal.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

For the cold storage industry, facility lighting has been a significant challenge owing to the subpar performance in refrigerated environments of the main industrial lighting choices, high intensity discharge (HID) and high intensity fluorescent (HIF) lighting fixtures. In general, these lighting systems consume too much energy, generate too much heat, and are expensive to maintain. And low-temperature environments, such as those in cold-storage facilities, exacerbate the disadvantages of HID and HIF lighting.

In contrast, an exemplary smart light-emitting diode (LED) lighting fixture offers consistent performance and durability in all temperature environments. For example, an LED lighting system can frequently cycle on/off without impacting the longevity of the lamp source or fixture, instantly return to full intensity when activated, even in −40° F. chillers, and generate minimal heat during operations, significantly reducing refrigeration loads.

Figure 1A:
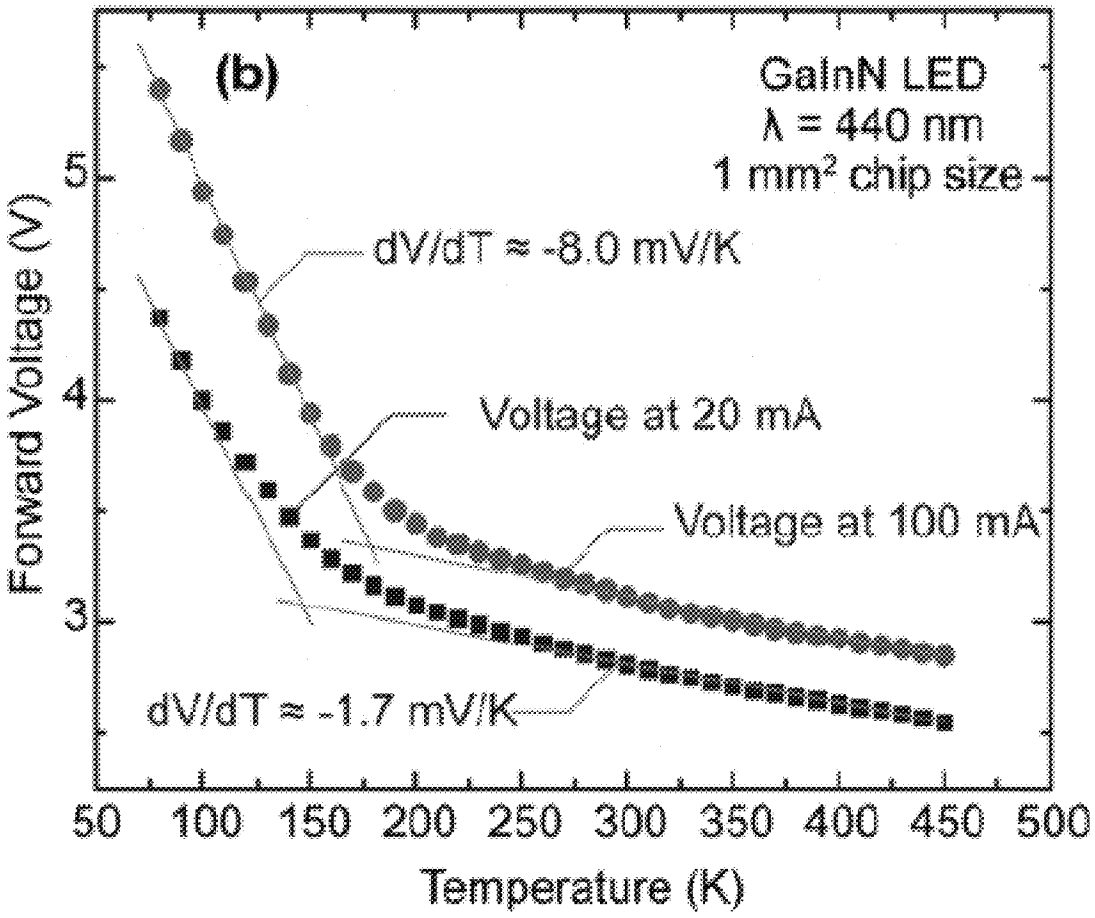
FIG. 1A shows a plot of the dependence of forward voltage on temperature for an exemplary light emitting diode.

However, an LED's forward voltage has a significant variation with temperature. For example, as shown in FIG. 1A for the specific example of a GaInN LEDs the forward LED voltage to maintain constant current increases with falling ambient temperatures. Over a temperature range of about 273 K to about 300 K, the forward voltage for a single LED increases by about 0.1 V. For strings of LEDs arranged in series, the total fluctuation in forward voltage can reach several volts, depending on the number of LEDs in series, their temperature performance, and the total temperature drop. Unfortunately, for LED drivers supplied by constant voltage sources, which tend to be more efficient and less expensive than other power supplies, it may not be possible to increase the voltage to compensate for increases in LED forward voltage at low temperature. In other words, a linear LED driver supplied by an efficient constant-voltage power supply might not provide enough voltage to drive LEDs arranged in series at extremely cold temperatures, such as typical cold-storage facility temperatures that run from −40° F. (−40° C.) to −4° F. (−20° C.).

Figure 1B:
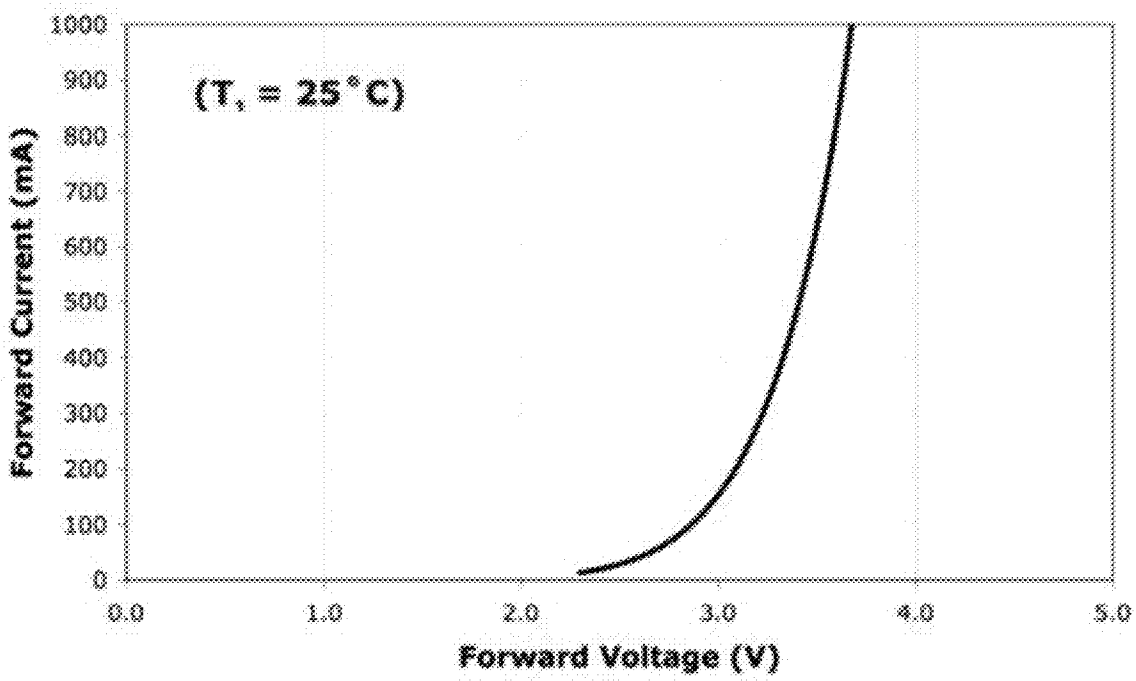
FIG. 1B shows the current versus voltage diagram of an LED.

LED drive current also varies with forward voltage as shown in FIG. 1B, which is a plot of forward current versus forward voltage (an I-V curve) for an LED at temperature of 25° C. For an LED to emit an appreciable amount of light, the forward voltage should exceed a characteristic on-voltage value, which typically is in the range of about 2-3 volts at room temperature as shown in FIG. 1B. Changing the LED temperature causes the current-voltage relationship to vary, in effect increasing or decreasing the LED voltage according to the relationship depicted in FIGS. 1A and 1B. But because an LED's voltage, current, and temperature are interrelated, knowledge of any two of these quantities makes it possible to solve for the third quantity. For example, if the current is fixed (can be assumed to be fixed), a temperature measurement can be used to find the voltage, or vice versa.

Figure 2A:
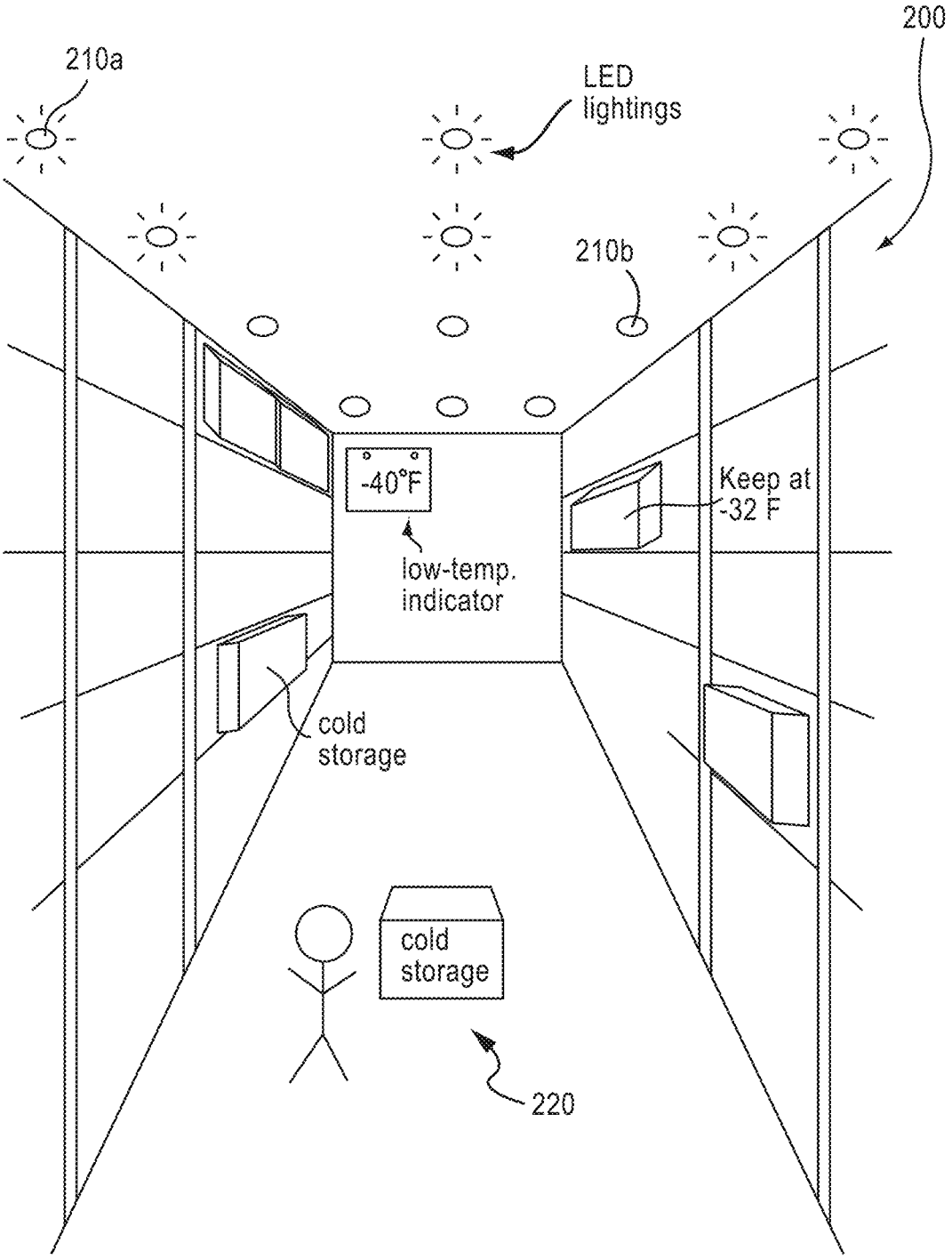
FIG. 2A shows an exemplary LED-based lighting fixture operating in a cold-storage facility.
Figure 2B:
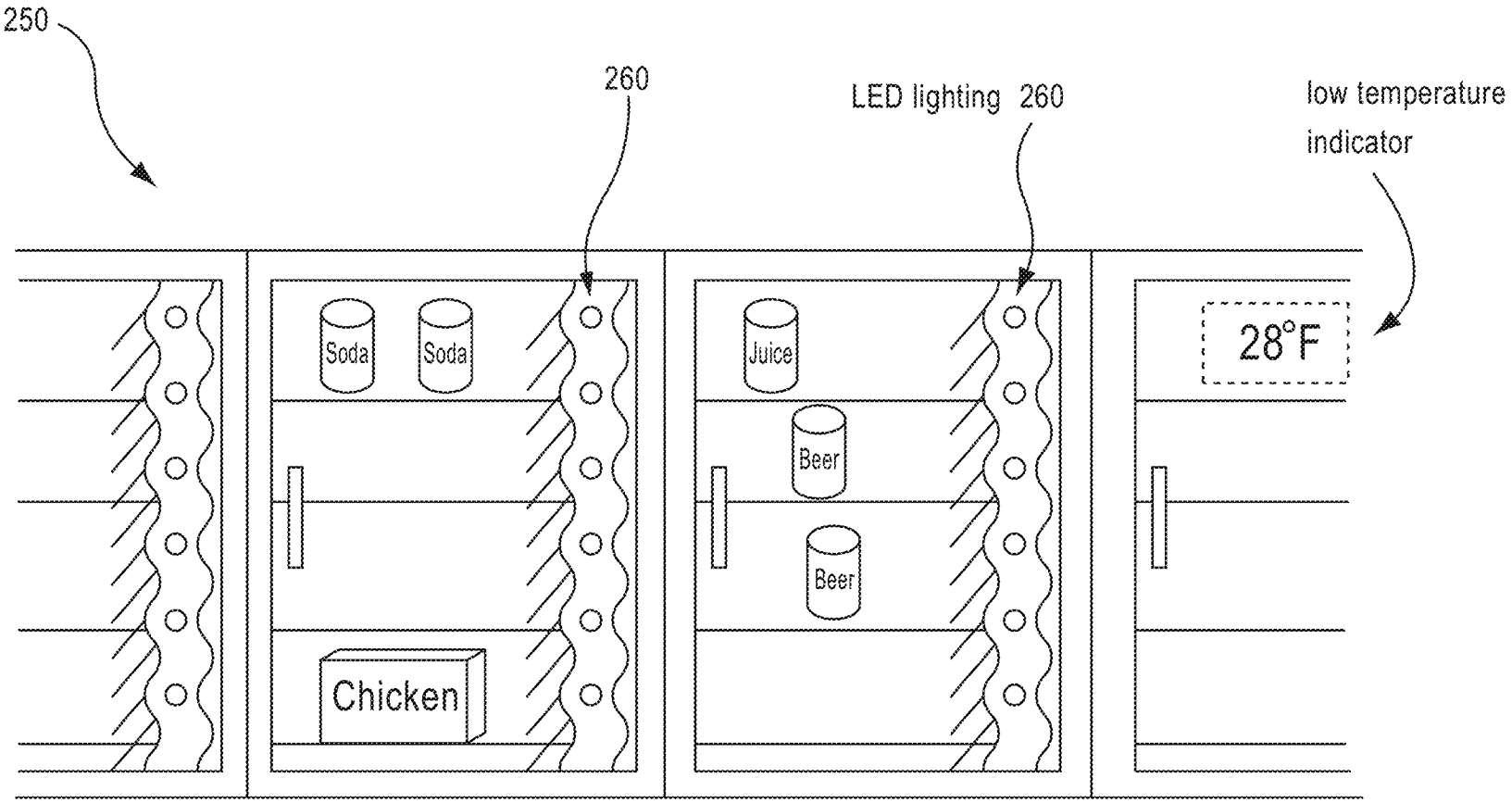
FIG. 2B shows an exemplary lighting system in the freezer section of a supermarket.

FIG. 2A shows LED-based lighting fixtures 210*a* and 210*b* (collectively, lighting fixtures 210) that uses the relationship among LED current, voltage, and temperature to operate in cold environments (e.g., environments at temperatures of 0° C., −5° C., −10° C., −15° C., −20° C., −25° C., −30° C., −35° C., −40° C., etc.). For instance, the fixture such as a refrigerated storage warehouse 200, with constant-voltage power supplies (not shown). Smaller fixtures 260 can be used in smaller cold environments, such as the refrigerators 250 shown in FIG. 2B.

As explained in greater detail below, each fixture 210 includes a sensor that measures (decreases in) temperature. Each fixture 210 also includes a processor or other circuitry that predicts the corresponding (increase in) LED forward voltage using the LEDs' temperature-voltage relationship at a given current. To compensate for changes in LED forward voltage, the lighting fixtures 210 and 260 include bypass circuits that short circuit one or more of the LEDs in the lighting fixture 210 to reduce the overall forward voltage of the plurality of LEDs. Further, since LEDs are more efficient at producing light at low temperatures (e.g., below 0° C.), so short-circuiting one or more LEDs may not significantly reduce the fixture's light output. In some cases, the bypass circuit may short-circuit the LED(s) to reduce power consumption for a given light output level at a given temperature.

In other cases, the LED fixtures may regulate the current supplied by the driver circuit(s) to the LEDs. For instance, an exemplary LED fixture may include a microcontroller or other processor that determines fluctuations in the LED drive current, possibly by measuring temperature or the current itself. The microcontroller may modulate the drive current by applying a drive current control signal (e.g., a pulse-width modulated signal) to the gate of a bipolar transistor that conducts current from the power supply to the driver or from the driver to the LEDs.

In addition, the LED-based lighting fixtures 210 can deliver light where and when needed, unlike HID and HIF fixtures, in part because of LEDs' fast response times. For instance, the LED fixture 210 may include a processor that increases light output when there is activity 220 in the area 200 and dims the lights when the area 200 is unoccupied as indicated by a signal from an ambient light sensor (not shown). The processor 200 may also brighten or dim the lights in response to a signal from an ambient light sensor to save energy in a process known as "daylight harvesting." For more information on occupancy- and daylight-based LED control, see, e.g., the following patent documents, each of which is incorporated herein by reference in its respective entirety: U.S. Pat. No. 8,536,802; U.S. Pre-Grant Publication No. 2012/0143357 A1; U.S. Pre-Grant Publication No. 2012/0235579 A1; U.S. Pre-Grant Publication No. 2014/0028199 A1; and International Patent Application No. WO 2013/067389.

Bypass Circuits to Reduce LED Forward Voltage

Figure 3A:
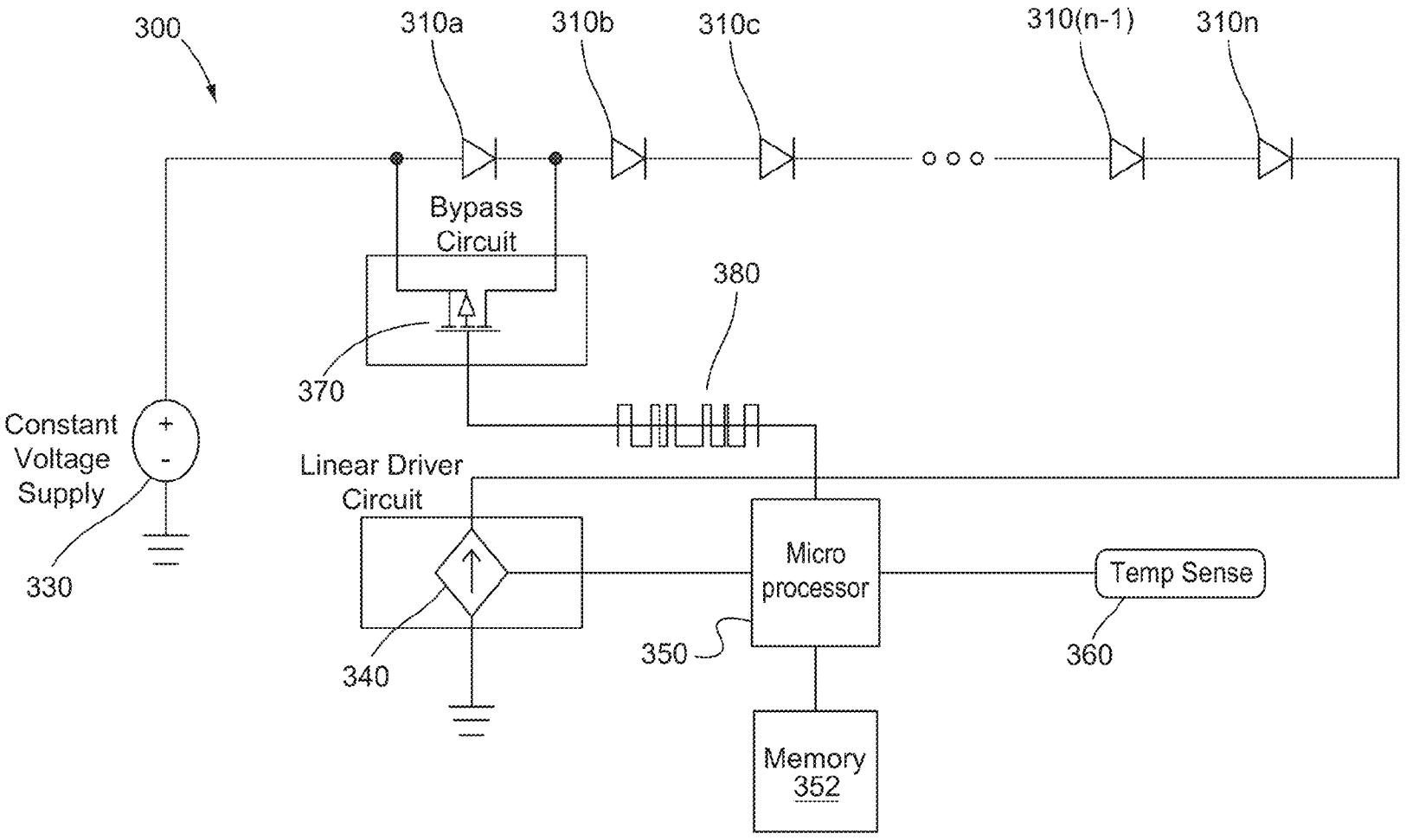
FIG. 3A shows an exemplary bypass circuit regulating, in response to a drop in temperature as measured by a sensor, the voltage available to a plurality of LEDs by short-circuiting one of the LEDs in the plurality of LEDs.

FIG. 3A shows a lighting fixture 300 that includes a plurality of LEDs 310*a*-310*n* (collectively, LEDs 310) that are in series with each other. For instance, the fixture 300 may include 10, 11, 12, 13, 14, 15, or more LEDs 310 in series depending on the available voltage, which is supplied by a constant-voltage power supply 330 via a non-switching linear driver 340. If the power supply 330 provides 60 V or less (e.g., 42 V with a tolerance of ±0.5 V), it may be considered by Underwriters' Labs to be a Class 2 Power Unit and thus subject to slightly less rigorous design constraints than certain other power supplies.

The linear driver 340 may be optimized for a given temperature (e.g., room-temperature), but fluctuations in ambient temperature may reduce the efficiency of the driver 340 and the LEDs 310. The lighting fixture 300 also includes one or more sensors 360 capable of measuring temperature, voltage overhead, and/or LED current drive may sense the voltage provided for driving the LEDs 310. And the fixture 300 includes a microcontroller 350 or other processor, that determines, based on the sensor measurements, whether there is sufficient voltage to drive the LEDs 310. A bypass circuit 370, shown in FIG. 3A as a switch, that short-circuits the first LED 310*a* if the voltage is too low to drive all of the LEDs 310.

For example, the sensor 360 may be implemented as a fully-integrated digital temperature sensor like the one shown in FIG. 11 and described below. The sensor 360 can also be implemented using other components, including but not limited to thermistors, thermocouples, and so forth. In operation, the sensor 360 measures a decrease in temperature and predict an associated voltage increase by using a relationship, such as a look-up table stored in memory (not shown), that relates voltage with temperature. As an alternative embodiment, the sensor 360 may measure a decrease in temperature and transmit a signal representing the measurement to a microcontroller 350 that uses the relationship relating LED forward voltage with temperature to determine the change in LED forward voltage at the lower temperature. For Cree LEDs, the conversion is about −2.5 mV/° C.; for other LEDs, the conversion may be higher or lower. In this case, the microcontroller 350 looks up the voltage-temperature conversion in a memory 352, which stores these characteristics in a look-up table or other representation of the LEDs' temperature-dependent current-voltage (I-V) characteristics. (In other embodiments, a voltmeter may be used to measure the voltage across the series, as discussed in more detail with respect to FIGS. 5 and 6.)

If the sensor 360 and/or processor 350 determine that there is not sufficient voltage and/or there is a requirement that the forward voltage should not exceed a prescribed amount (e.g., to protect the integrity of the LEDs), the first LED 310*a* (or, equivalently, the last LED 310*n*) may be "bypassed" (e.g., short-circuited) to reduce the overall forward voltage of the LEDs 310. Bypassing one or more of the LEDs reduces the total forward voltage and makes it possible to drive at least some of the LEDs 310 at full current.

In some implementations, the microcontroller 350 may apply a "bypass-circuit" control signal (e.g., a pulse-width-modulated (PWM) digital signal) 380 to a bypass circuit 370 to effect the bypassing of the first LED 310*a* (or the last LED 310*n*) in the series 310. This bypass circuit 370 may include a field-effect transistor or switching component in addition to various support components, e.g., as described below with respect to FIG. 10. It can be implemented separately from the linear driver circuit 340 or located on the same circuit board as the linear driver circuit 340. Upon receiving the control signal 380, the bypass-circuit 370 short-circuits the first LED 310*a* and consequently reduce the overall forward voltage needed for the plurality of LEDs. (In alternative implementations, the bypass circuit 370 may be included in the linear driver 340, and the processor 350 may transmit the control signal directly to the linear driver 340.)

Once the first LED 310*a* has been electrically removed (short-circuited) from the series of LEDs 310, it may be checked periodically to determine if there is sufficient voltage available to drive all the LEDs 310. For example, if the temperature has increased, the power supply DC voltage may be adequate to provide a lower forward voltage to drive the LEDs 310. In such embodiments, the microcontroller 350 and bypass-circuit 370 may periodically enable the first LED 310*a* to check whether normal, un-bypassed operation has become possible. This periodic disabling of the bypass circuit may be performed at a rate too fast to observe with the naked eye, e.g., at a speed of 100 Hz or faster (i.e., a period less than about 20 milliseconds). The fast switching speed leads to an imperceptible flicker of the first LED 310*a* and possibly of the other LEDs 310 as well. If the measurement shows that the forward voltage has dropped below the supply voltage (e.g., because the temperature has risen), then the bypass circuit may re-enable the first LED 310. Otherwise, the bypass circuit may disable the first LED 310*a* after the measurement and check the voltage again later (e.g., every 30 seconds, 60 seconds, five minutes, ten minutes, etc.).

Figure 3B:
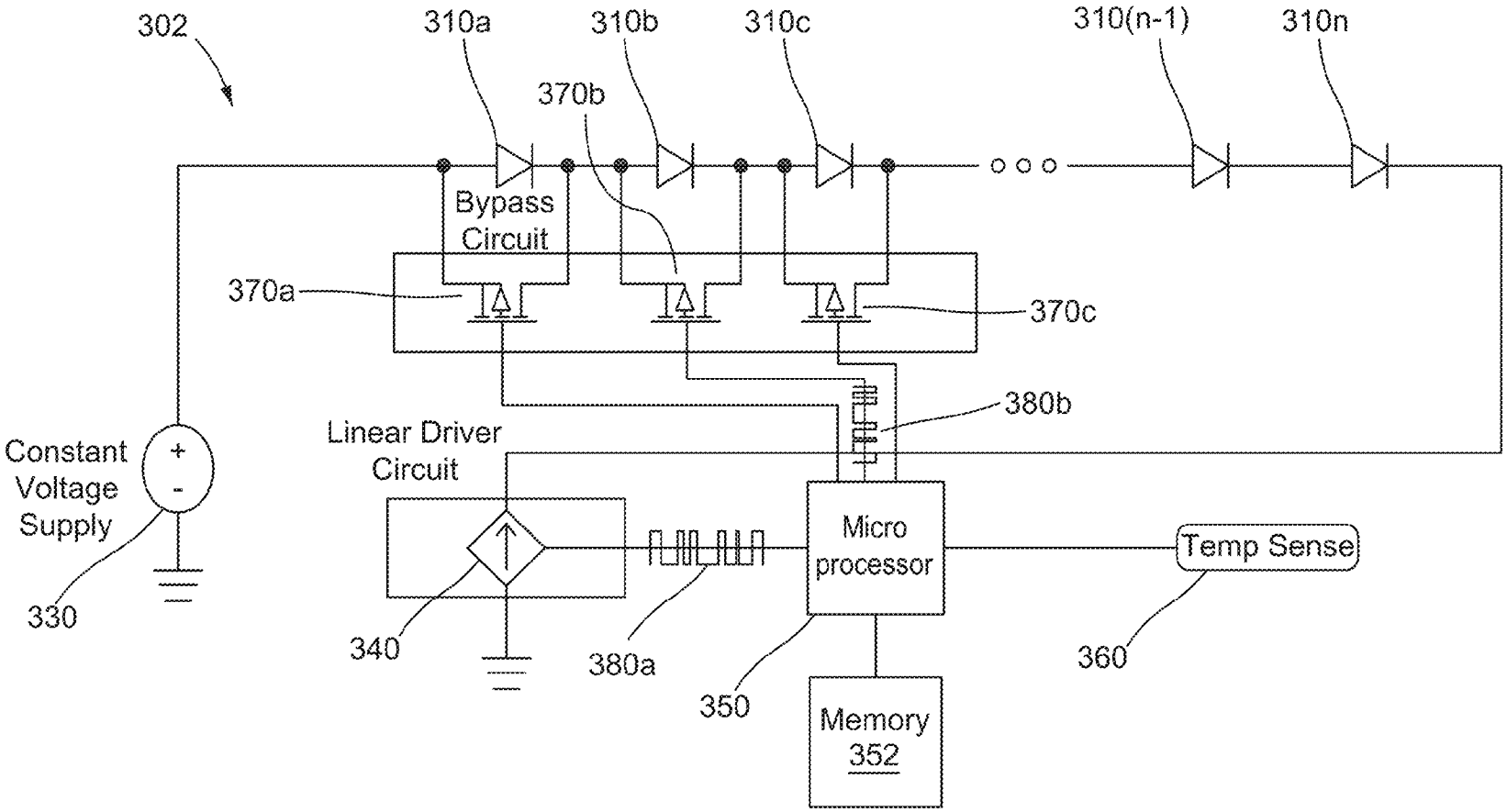
FIG. 3B shows an exemplary lighting fixture that includes several LED light bars connected to a direct current (DC) power supply through respective low-voltage drivers and a bypass circuit.
Figure 10:
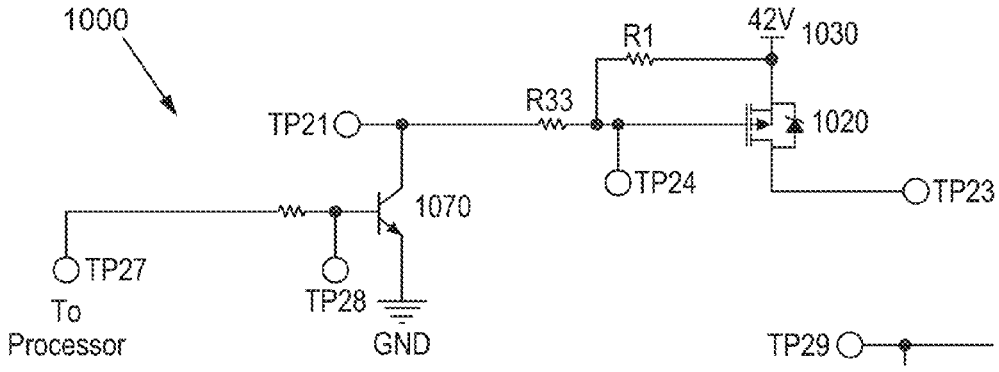
FIG. 10 is a circuit diagram that shows an exemplary bypass circuit.

FIG. 3B shows how multiple "bypass circuits" 370*a*-370*c* (collectively, bypass circuits 370) may be coupled to the LEDs 310 to allow for individual "bypassing" of some or all of the LEDs. For example, the bypass circuits 370 may comprise respective transistors, e.g., as shown in FIG. 10. Upon receiving a signal 380*b* from the microcontroller 350, some or all of these transistors may short out a respective LED 310. For example, in FIG. 3B, bypass circuit 370*b* is associated with LED 310*b*, bypass circuit 370*c* is associated with LED 310*c*, etc., and each bypass circuit 370 is connected to the microcontroller 350. As such, the microcontroller 350 can switch on or disable the bypass circuits 370 individually and consequently can control the overall total voltage across the LEDs 310 more finely. This may allow the LEDs 310 to illuminate the environment over a wider range of voltage swings (and a wider range of temperatures).

Figure 4:
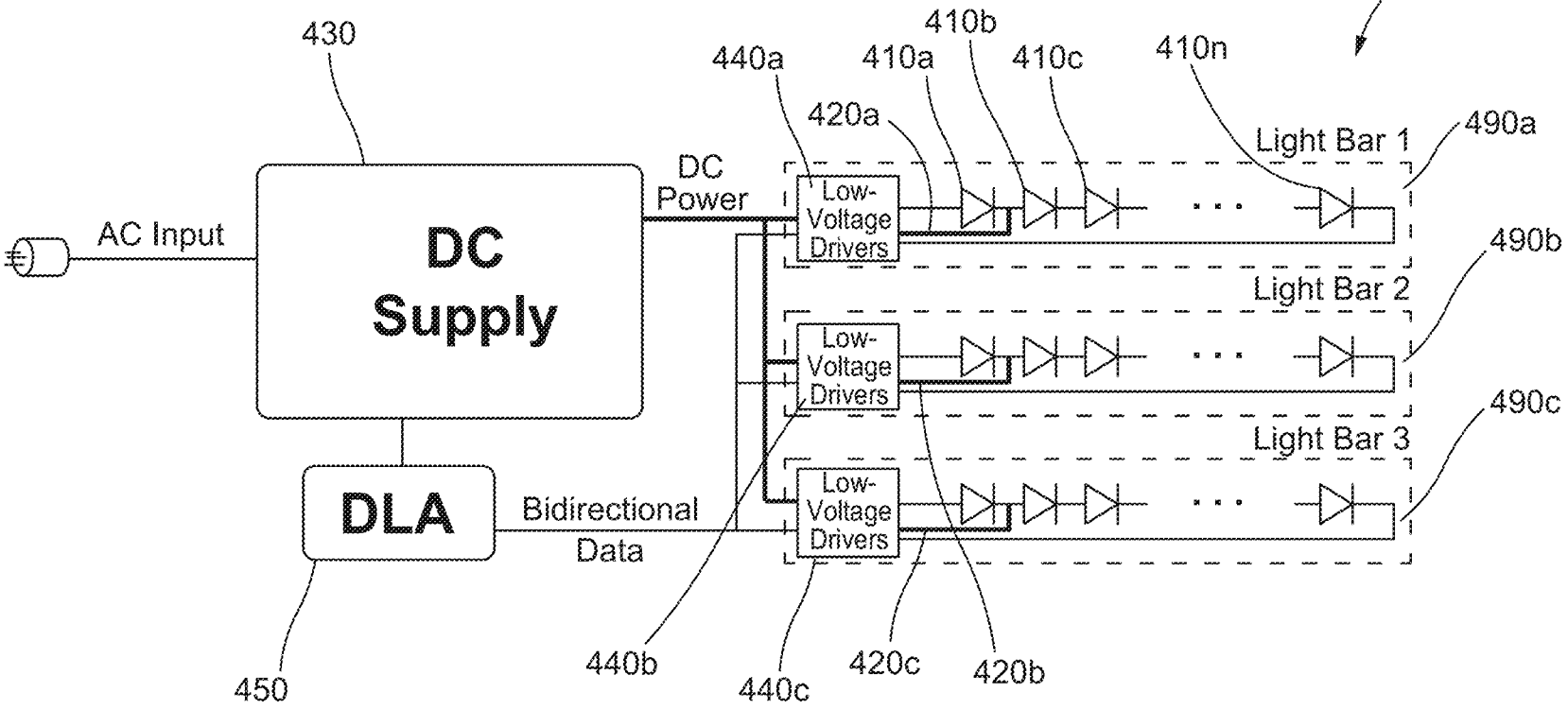
FIG. 4 shows an exemplary bypass circuit regulating the voltage available to a plurality of LEDs in response to an increase in series voltage due to a drop in temperature by short-circuiting an LED in the plurality of LEDs.

With reference to FIG. 4, a lighting fixture 400 may include light bars 490*a*-490*c* (collectively, light bars 490) that each comprise several LEDs 410*a*-410*n* (collectively, LEDs 410) in series. Each light bar 490 may be connected to a constant-voltage power supply 430 through a respective low-voltage driver 440*a*-440*c* (collectively, drivers 440). In some embodiments, the constant-voltage power supply 430 and low-voltage drivers 440 may be commonly available modular power supplies and drivers, respectively.

As explained above, the combined forward voltages of the LEDs 410 in each light bar 490 may exceed the available DC voltage as the ambient temperature drops. In some implementations, the low voltage drivers 440 of some or all of the light bars 410 may serve as sensors that measure the temperature and/or voltage to determine if the forward voltage exceeds the DC voltage available for each light bar 490. For example, if the same amount of forward voltage should be available to each light bar 490 in the lighting fixture 400, the voltage drivers 440 may check to determine if the total forward voltage at each light bar 490 exceeds the total available DC voltage divided by the number of light bars 490 in the lighting fixture 400.

In some embodiments, the lighting fixture 400 includes a digital light agent (DLA) module 450, which may be implemented as a processor, that may determine, upon receiving the sensing measurements from the voltage drivers 440, if the total forward voltages for the light bars 490 have exceeded the apportioned DC voltages. In other embodiments, the voltage drivers 490 may have made such determinations and may transmit the result to the DLA module 450. Once it has been determined that the forward voltages at one or more of the light bars exceed the available DC voltage, and/or the total combined forward voltage of all the LEDs 410 exceeds the power supply DC voltage, the DLA module 450 may signal the voltage drivers to engage bypass circuits 420*a*-420*c* (collectively, bypass circuits 420) included in each light bar 490. In some embodiments, when engaged, the bypass circuits 420 may short-circuit at least one LED 410 in each light bar 490 (FIG. 4 as shown depicts the short-circuiting of the first LED of the light bar). For example, the number of LEDs short-circuited by different bypass circuits may be the same and/or different.

Voltage Monitoring for Low-Temperature Operation

Figure 5:
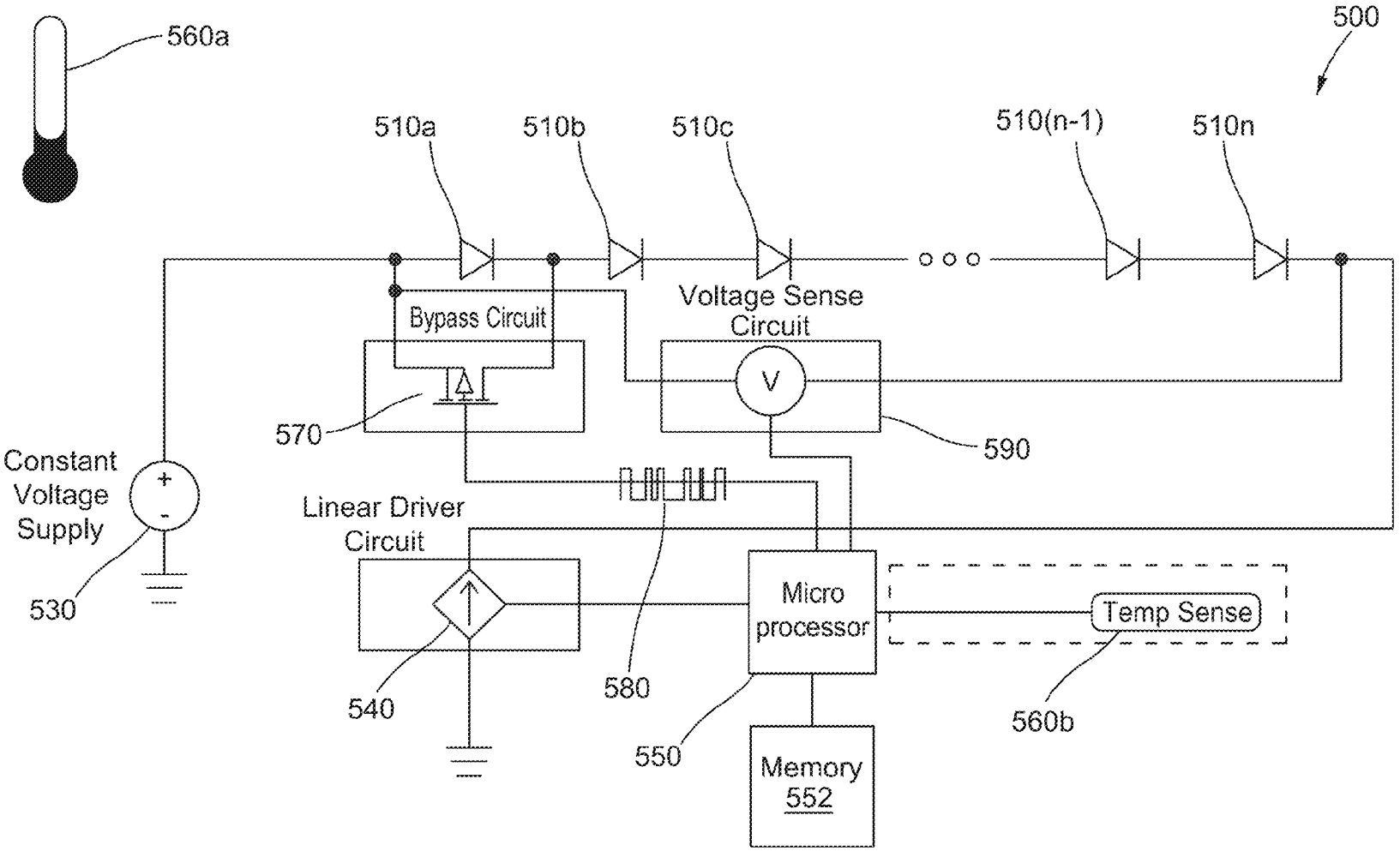
FIG. 5 shows an exemplary bypass circuit regulating, in response to a drop in temperature as measured by a sensor, the voltage available to a plurality of LEDs by short-circuiting any number of LEDs in the plurality of LEDs.

FIG. 5 shows a plurality of LEDs 510*a*-510*n* (collectively, LEDs 510) in series with each other and connected to a DC voltage power supply 530 via a non-switching linear driver 540. The linear driver may be optimized for operation at a given temperature (e.g., room-temperature), but fluctuations in ambient temperature may render the operation of the driver and the LEDs less efficient than the optimal case. In embodiments similar to those discussed with reference to FIG. 3A, a sensor 560*b* measures the ambient temperature 560*a* and determines whether there is sufficient voltage to drive the plurality of LEDs. In alternative embodiments, the sensor may relay the measurements to the microcontroller 550 which may then look up, in a memory 552, a relationship that relates LED forward voltages with temperature to determine whether there is sufficient voltage to drive the plurality of LEDs.

In other embodiments, a voltmeter 590 measures the voltage overhead across the plurality of the LEDs and may determine if the forward voltage of the plurality of LEDs exceeds the available DC voltage, and provide the microcontroller with the result. In some embodiments, the sensor 590 may measure the forward voltage of the plurality of LEDs and relay the measured data to the microcontroller 550 for the microcontroller to determine if the DC power supply provides sufficient voltage to drive the LEDs 510. Upon determining that the forward voltage has exceeded the power supply DC voltage and/or another prescribed voltage threshold, the microcontroller 550 applies a "bypass-circuit" control signal 580 (e.g., a pulse-width-modulated (PWM) digital signal) to the bypass circuit 570. This causes the bypass circuit 570 to short-circuit the first LED 510*a* (or last LED, as an alternative example) in the series as shown in FIG. 5. As explained above, short-circuiting the first LED 510*a* reduces the overall forward voltage needed for the series of LEDs.

After the first LED 510*a* has been short-circuited and the total forward voltage of the remaining plurality of LEDs reduced to or below the DC voltage from the power supply 530, the microcontroller 550 may disable the bypass switch 570 and bring the shorted LED 510*a* back online periodically to check if there is enough forward voltage to drive all the LEDs 510. For example, the ambient temperature may have increased and the required total forward voltage for the plurality of LEDs including the shorted-out LED may have been reduced to below the DC voltage. In such embodiments, the microcontroller 550 may periodically disable the "bypass circuit" (e.g., switch off the bypass circuit 570) to check whether un-bypassed operation has become possible by, for example, measuring the total forward voltage again with the voltmeter 590. This periodic disabling of the bypass circuit may be performed at a rate too fast to observe with the naked eye, e.g., at a speed of 100 Hz or faster (i.e., a period less than about 20 milliseconds). For example, the bypass circuit may be disabled for a period less than about 20 milliseconds, 10 milliseconds, 5 milliseconds, etc.

Figure 6:
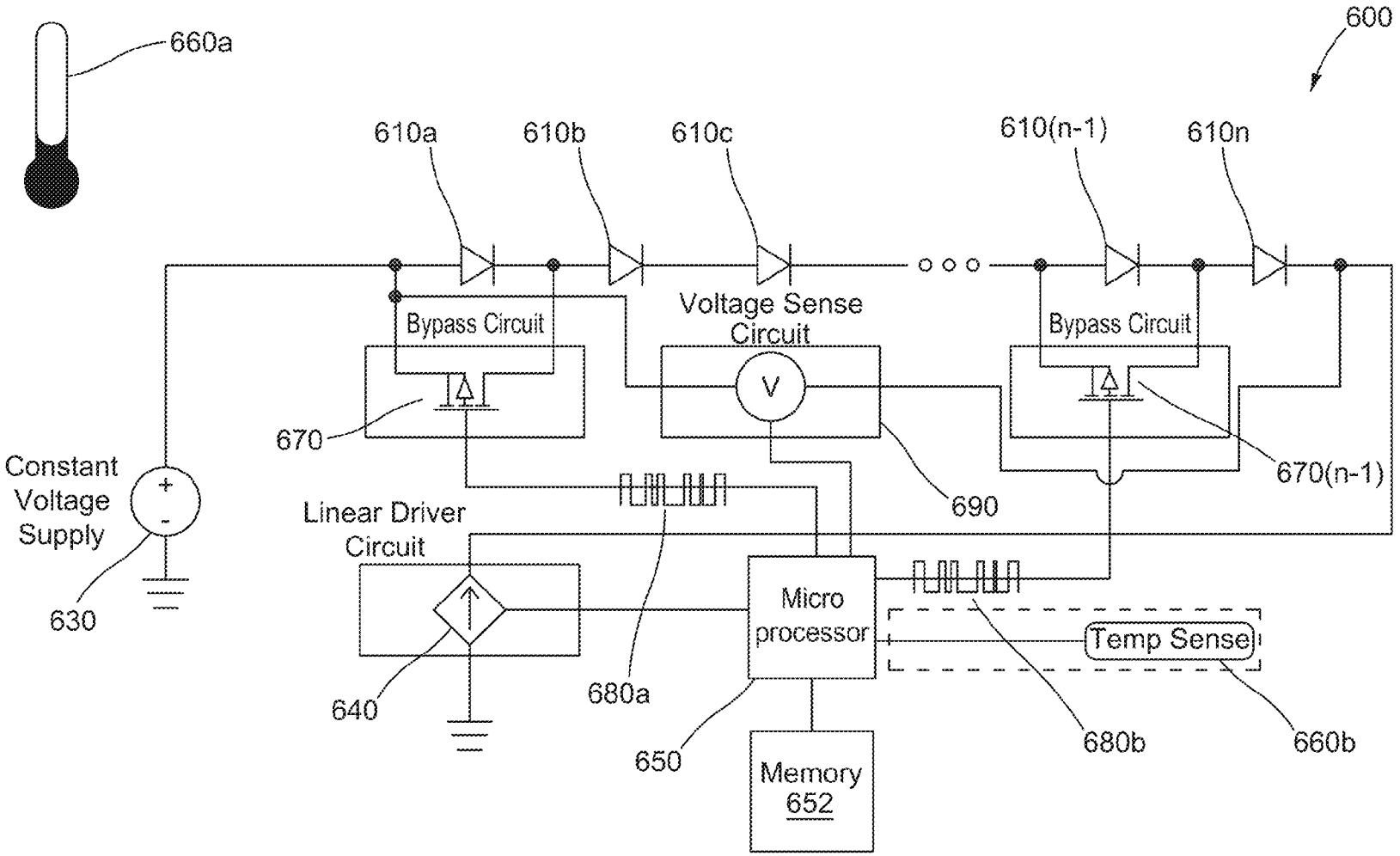
FIG. 6 shows an exemplary bypass circuit regulating the amount of voltage available to a plurality of LEDs in response to an increase in series voltage due to a drop in temperature by short-circuiting any number of LEDs in the plurality of LEDs.

FIG. 6 shows a fixture 600 that includes multiple bypass circuits 620*a* and 620*b* (collectively, bypass circuits 620), each of which is coupled to a different LED 610 in the series of LEDs 610*a*-610*n* (collectively, LEDs 610). The LEDs 610 are driven by a linear driver circuit 640 that receives power from a constant-voltage power supply 630. As in FIG. 5, a processor 650 determines the temperature by measuring the forward LED voltage with a voltage sense circuit 690 (e.g., a voltmeter) and looking up the temperature 660*a* corresponding to the measured voltage and drive current in a look-up table or other representation stored in a memory 652. (The processor 600 may also measure the temperature 660*a* using a temperature sensor 660*b* and determine the LED forward voltage based on the temperature 660*a*.) If the processor 650 determines that the forward LED voltage has risen above the power supply voltage or another threshold, the processor generates one or more control signals 680*a* and 680*b* for actuating the bypass circuits 670*a* through 670($n$−1) (collectively, bypass circuits 670), only some of which are shown for clarity.

Upon receiving the control signals 680*a* and 680*b* from the microcontroller 650, the bypass circuits 670*a* and 670*b* may short-circuit the associated LED(s). For example, in FIG. 6, bypass circuit/switch 670*a* is associated with LED 610*a*, bypass circuit/switch 670*b* is associated with LED 610*b*, etc. As such, the microcontroller 650 can switch on or disable the bypass circuits 670 individually and consequently can control the overall total voltage across the LEDs 610 more finely. This may allow the LEDs 610 to illuminate the environment over a wider range of voltage swings (and a wider range of temperatures). This, for example, may also allow for the wear that ensues from the switching on/off of LEDs to be distributed evenly amongst some or all the LEDs in the series.

If desired, the processor 650 may actuate the bypass circuits 620*a* and 620*b* independently. That is, in FIG. 6, the processor 650 can switch on or disable the bypass circuits 620*a* and 620*b* individually, and consequently would be able to control the voltage across each LED 610*a*, 610*c* separately. This, for example, may allow for the wear that ensues from the switching on/off of LEDs to be distributed evenly amongst some or all the LEDs in the series.

Current Monitoring for Low-Temperature Operation

Figure 7:
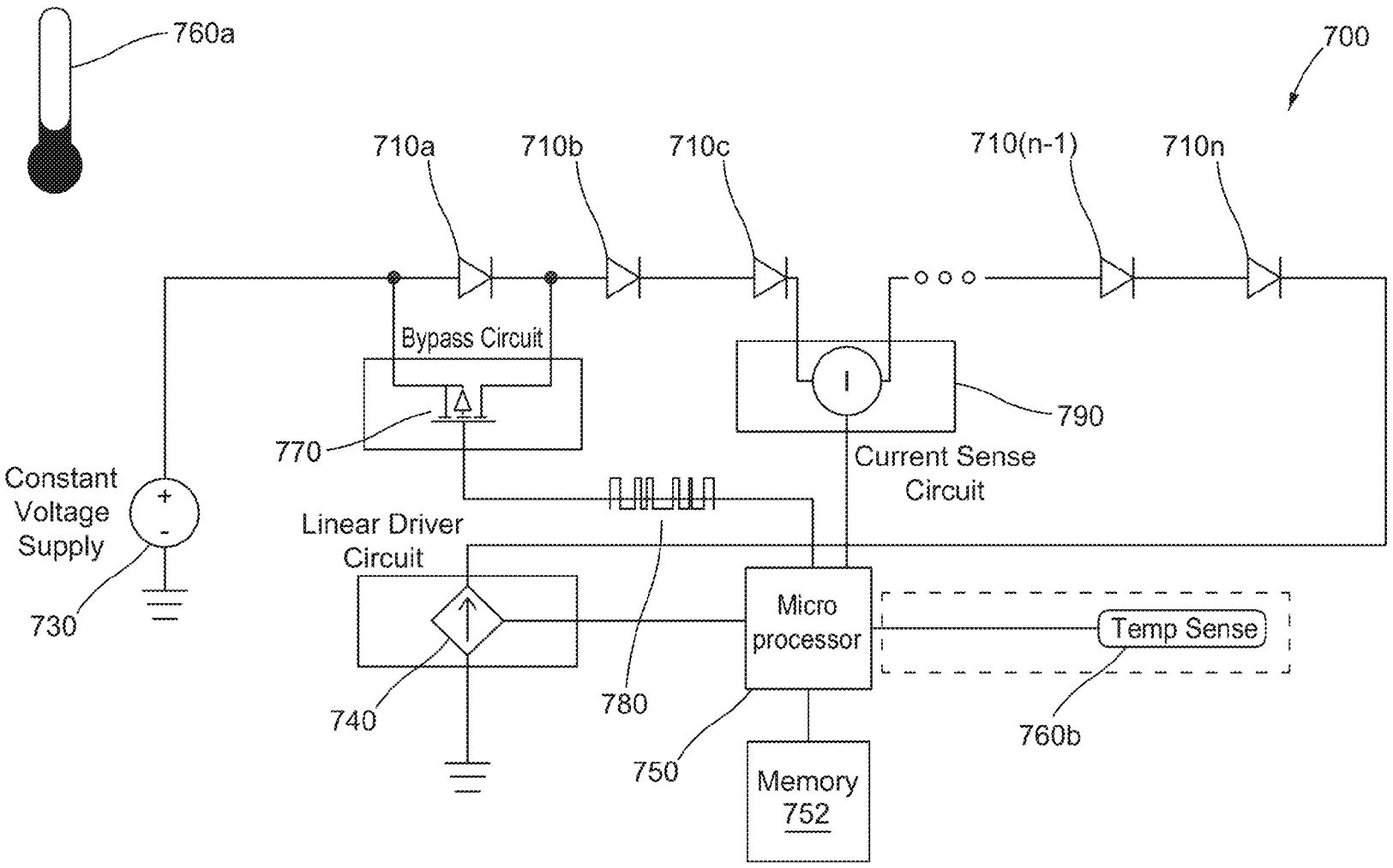
FIG. 7 shows an exemplary bypass circuit regulating, in response to a drop in temperature, the amount of drive current available to a plurality of LEDs by switching a transistor using a drive current control signal.

FIG. 7 illustrates an LED lighting fixture 700 with a processor 750 that controls the current supplied to LEDs 710 in response to changes in temperature. The LEDs 710 are connected to a power supply (not shown) via a linear driver 740 and a bypass circuit 770, which may also be part of the linear driver 740. In this case, the linear driver 740 can be an inexpensive device, e.g., a driver that does not provide or use a precision current reference for controlling the current supplied to the LEDs 710. And the bypass circuit 770 can be a transistor-based device like the bypass circuits shown in FIGS. 3A, 3B, 5, 6, 7, and 10. It can also comprise one or more bipolar transistors whose base-emitter voltage drop may be used to set a desired drive current for the LEDs 710. In operation, the processor 750 and the transistors manage the level of the drive current supplied to the LEDs 710.

As shown in FIG. 7, a current sensor 790 coupled in series with the LEDs 710 may measure the LED drive current. The current sensor 790 provides this measurement to the processor 750, which determines whether the drive current has deviated from a desired set-point based on values stored in a memory 752. The processor 750 may also determine the voltage or temperature based on the current measurement.

In other embodiments, a temperature sensor 760*b* may provide a measurement of the temperature 760*a* to the processor 750, which determines if the drive current has deviated from the desired drive current set-point based on the temperature measurement based on values stored in the memory 752. For example, the sensor and/or the microcontroller may use a relationship that relates current with temperature, and based on a temperature measurement from the sensor 760*b* may be able to determine the drive current at the plurality of LEDs 710.

Upon determining the deviation of the drive current from the drive current set-point, in some embodiments, the processor 750 may apply a drive current control signal (e.g., a pulse-width-modulated (PWM) digital signal) 780 to the bypass circuit 770 to adjust the drive current to the desired value. For example, if the ambient temperature drops and the output current exceeds the desired value, the processor 750 may apply a PWM signal to the transistor 770 in order to reduce the driver current to the set-point level. In some embodiments, the same PWM signal can also be used to dim the LEDs 710, e.g., in response to an occupancy event or a change in the ambient light level.

Compensation for Temperature-Induced LED Drive Voltage Fluctuation

Figure 8:
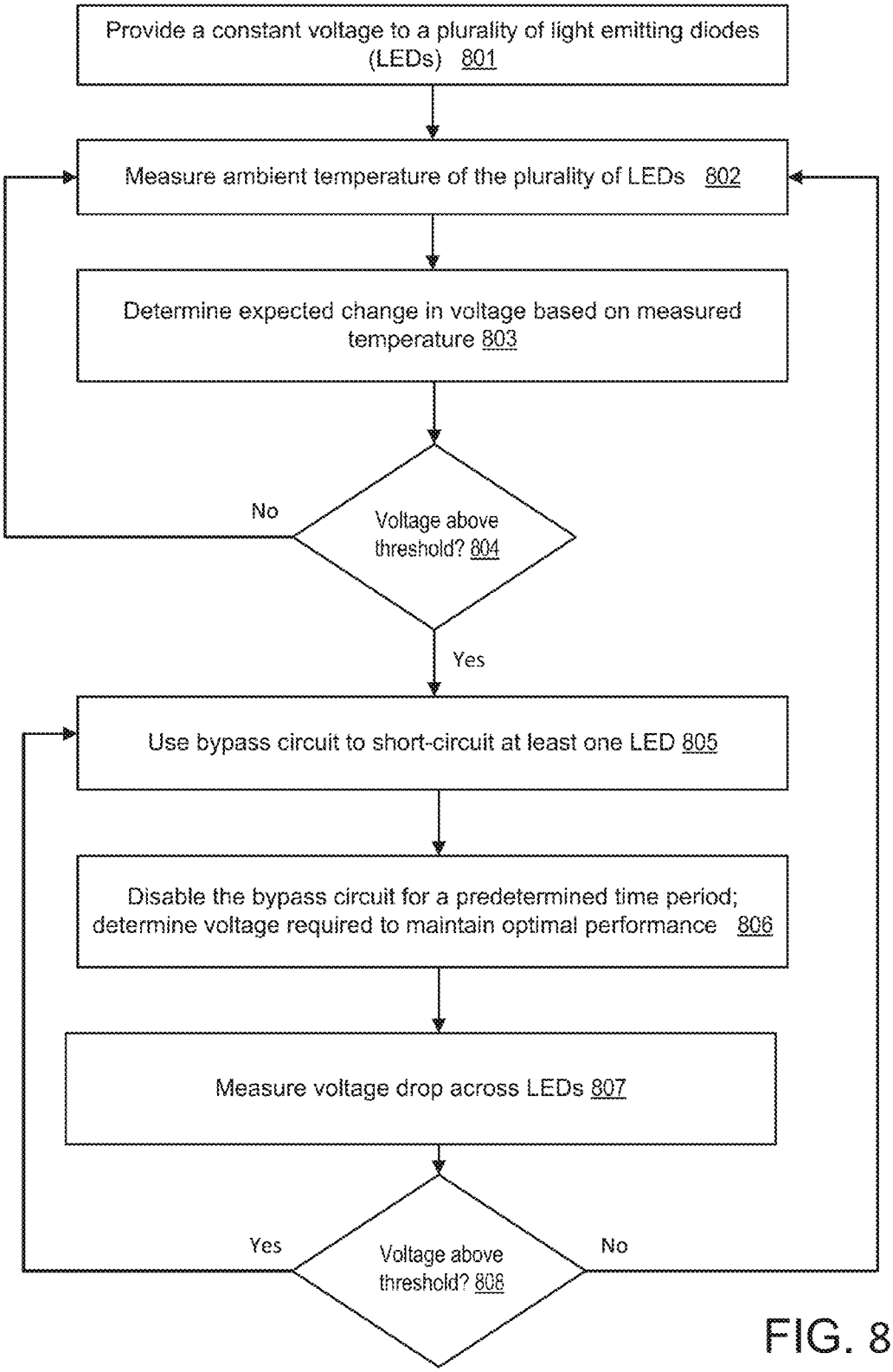
FIG. 8 shows a flow diagram of an exemplary process for managing the voltage across LEDs operating in a low temperature environment.

FIG. 8 shows an exemplary process for managing the voltage across LEDs operating in a low temperature environment. In some embodiments, at step 801, a plurality of LEDs are connected to a constant voltage source. For example, the voltage source may be a DC voltage source power supply connected to a linear driver. At step 802, one may measure physical quantities such as ambient temperature of the plurality of the LEDs, and determine, at step 803, the forward voltage of the LEDs by using a relationship that relates temperature to forward voltages. In other embodiments, one may measure the voltage overhead and/or LED current drive and determine the forward voltage.

At step 804, the measured drive voltage is compared to a threshold amount (e.g., the DC voltage provided by the voltage source). If the measured drive voltage is under the threshold, the temperature may be periodically monitored to check if the forward voltage remains under the threshold. If the measured forward voltage exceeds the threshold, at step 805, a processor (e.g., a microcontroller) may effectuate the bypassing of at least one of the LEDs in the plurality of LEDs using a bypass circuit. In some embodiments, the bypassing/short-circuiting may electrically isolate the LED and bring the overall forward voltage across the plurality of LEDs under the threshold.

At step 806, the microcontroller may disable the bypass circuit to determine if the LED forward voltage has dropped. For example, the temperature may have increased and the forward voltage required to drive the LEDs at the desired drive current may have decreased below the threshold. In some embodiments, the switching on/off of the bypass circuit may be undertaken at an imperceptible rate to humans. If a measurement of the forward voltage at step 807 shows that the forward voltage still exceeds the threshold, the bypass circuit is re-engaged and at least one LED is short-circuited at step 808. If, on the other hand, the forward voltage has fallen under the threshold, the bypass circuit is left disabled and the ambient temperature is monitored to check the forward voltage remains below the threshold.

Figure 9:
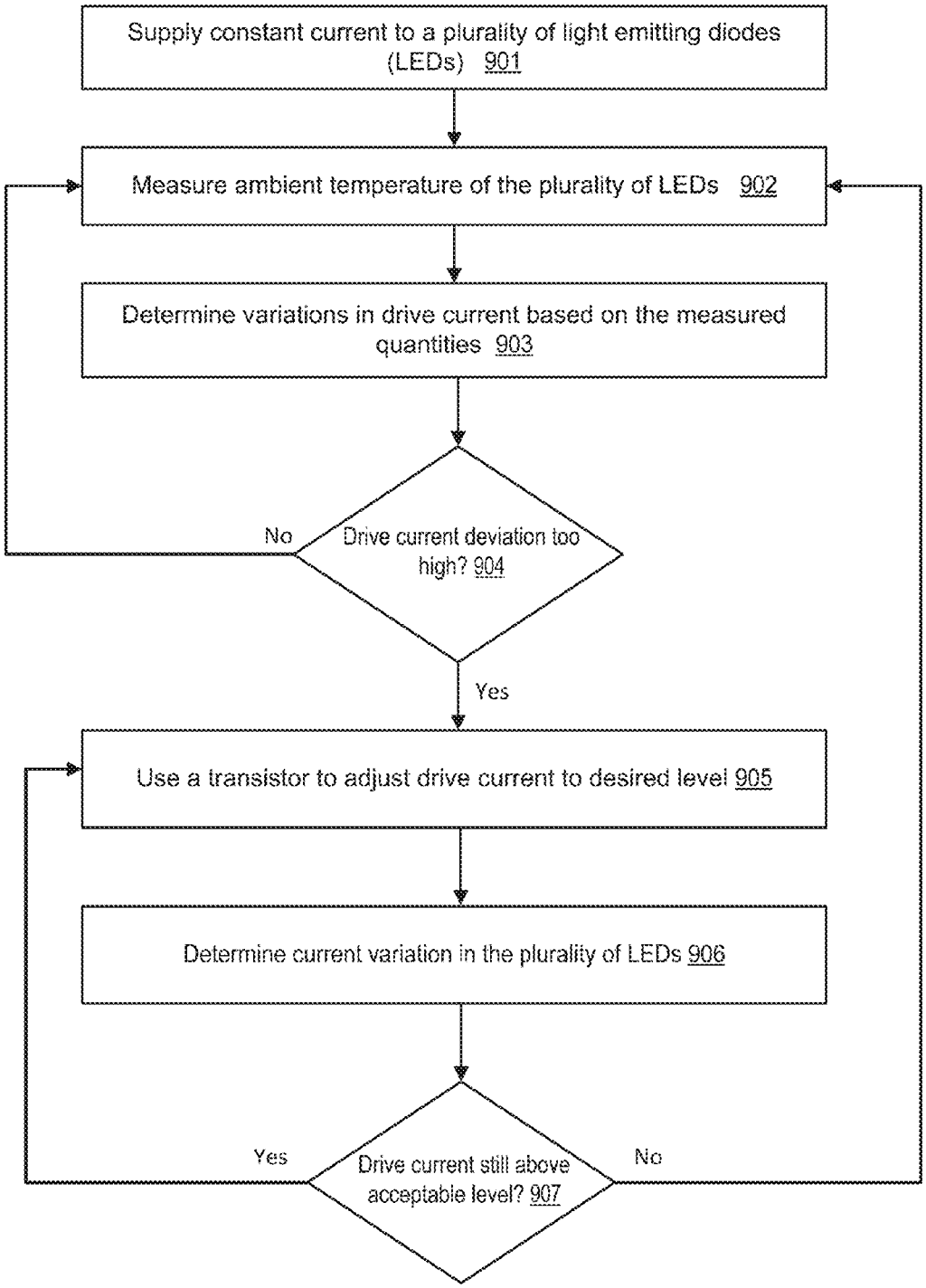
FIG. 9 shows a flow diagram of an exemplary process for managing the current supplied to a plurality of LEDs operating in a low temperature environment.

FIG. 9 shows an exemplary process for managing the drive current supplied to a plurality of LEDs operating in a low temperature environment. At step 901, a constant voltage supply is connected to a plurality of LEDs via a linear driver to maintain a given drive current through the plurality of LEDs. At step 902, physical quantities such as ambient temperature of the plurality of the LEDs are measured, and based on the measurements, at step 903, the drive current at the LEDs, and the variations due to fluctuations in temperature may be determined. For example, a drop in temperature may result in an increase in the drive current, and such a change in the drive current may be determined at step 903. In some embodiments, the fluctuations in drive current may also be determined by measuring the current itself and/or voltage overhead using a sensor.

At step 904, if the drive current is determined to be acceptable (e.g., the drive current variations are within some acceptable bounds of the desired drive current set-point), the temperature may be periodically monitored to check if the drive current variations remains within the bounds. If, on the other hand, the current variations are not acceptable, a microcontroller may apply, at step 905, a drive current control signal to a transistor and/or a linear driver circuit to keep the current at the desired level of drive current. For example, if a drop in temperature has resulted in an increase of the drive current, the microprocessor may signal the transistor and/or the linear driver to reduce the drive current to the desired level. At step 906, one may determine if the drive current has attained the desired level, and if so, at step 907, the temperature may be periodically monitored to check the drive current maintains at the desired level. If, on the other hand, the drive current has not reached the desired level, the microcontroller may apply additional signal to the transistor and/or linear driver to adjust the drive current at the plurality of LEDs to the desired level.

Bypass Circuits

FIG. 10 shows a circuit diagram of an exemplary bypass circuit 1000. The bypass circuit 1000 includes a metal-oxide-semiconductor field-effect transistor (MOSFET) 1020 that is connected to a DC voltage power supply 1030. For example, the voltage supply 1030 may be a constant-voltage source (e.g., 42V). The MOSFET 1020 is also connected to a bipolar junction transistor 1070 whose base is connected to a microcontroller or other processor (not shown). In some embodiments, the bypass circuit 1000 also contains several resistors, which may be connected to the transistors in series and/or parallel for use in, amongst other things, monitoring and/or testing the bypass circuit 1000. For example, the MOSFET 1020 may be connected to a resistor R1 in parallel, and the transistor 1070 may be connected to a smaller resistor R37 in series. In some embodiments, a much higher resistor R33 may be placed between the gate of the MOSFET 1020 and the collector of the transistor 1070. In some embodiments, the monitoring and/or testing may be conduct at several points throughout the circuit. For example, in the embodiments depicted in FIG. 10, several test points (TPs), such as TP23, TP24, TP21, TP28 and/or TP27 are used to determine voltage and/or current in the bypass circuit.

Temperature Sensors

Figure 11:
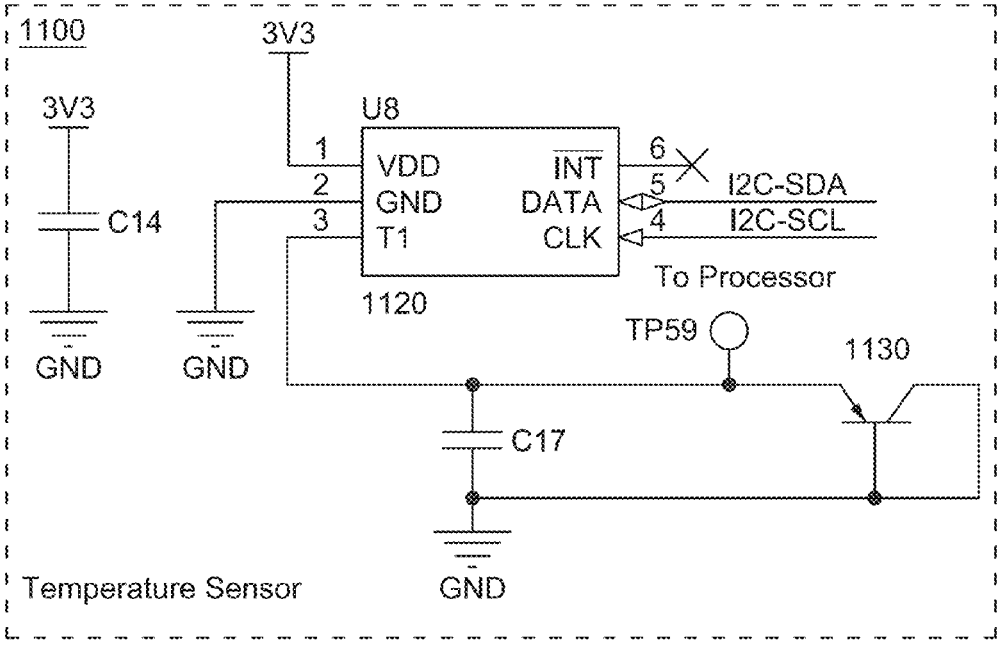
FIG. 11 is a circuit diagram that shows an exemplary temperature sensor.

FIG. 11 shows a circuit diagram of an exemplary temperature sensor. In some embodiments, the temperature sensor 1100 comprises a thermal sensor 1120 capable of measuring its own internal temperature and the temperature of a remote/external component such as a transistor, diode, LED, etc. In this case, the thermal sensor 1120 comprises a digital temperature supervisor; in other examples, the thermal sensor 1120 may comprise a thermocouple, thermistor, or other suitable temperature-sensitive device or component. In some embodiments, the thermal sensor 1120 may measure the temperature using a transistor 1170. Such a thermal sensor may have an effective capacitance C14. The measurements of the temperature sensor 1100 may be communicated to a microcontroller 1150 via a suitable electrical connection as depicted in FIG. 11.

Conclusion

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of designing and making the coupling structures and diffractive optical elements disclosed herein may be implemented using hardware, software or a combination thereof. When implemented in software, the software code can be executed on any suitable processor or collection of processors, whether provided in a single computer or distributed among multiple computers.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including a Personal Digital Assistant (PDA), a smart phone or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes (e.g., of designing and making the coupling structures and diffractive optical elements disclosed above) outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

The terms "program" or "software" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion amongst a number of different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A lighting fixture comprising:

a plurality of light emitting diodes arranged in series, the plurality of light emitting diodes comprising at least one first light emitting diode;

a constant-voltage power supply, operably coupled to the plurality of light emitting diodes, to provide a constant voltage across the plurality of light emitting diodes;

a sensor, in electrical communication with the plurality of light emitting diodes, to measure a decrease in temperature of the plurality of light emitting diodes, the decrease in temperature of the plurality of light emitting diodes causing an increase in series voltage across the plurality of light emitting diodes; and a bypass circuit, operably coupled to the sensor, to short-circuit the at least one first light emitting diode in response to the increase in the series voltage so as to reduce the series voltage below the constant voltage provided by the constant-voltage power supply, wherein:

the bypass circuit is configured to enable the at least one first light emitting diode for a predetermined period after disabling the at least one first light emitting diode in response to the increase in the series voltage; and the sensor is configured to measure a change in the temperature of the plurality of light emitting diodes while the at least one light emitting diode is enabled.

2. The apparatus of claim 1, wherein the predetermined period is less than about 20 milliseconds.

3. The apparatus of claim 2, wherein the bypass circuit is configured to short-circuit the at least one first light emitting diode after the sensor has measured the change in temperature of the plurality of light emitting diodes.

4. The apparatus of claim 1, wherein the bypass circuit is configured to short-circuit the at least one first light emitting diode when the series voltage exceeds a threshold voltage.

5. A method of operating a plurality of light emitting diodes arranged in series at low temperature, the method comprising:

(A) providing, via a constant-voltage power supply operably coupled to the plurality of light emitting diodes, a constant voltage across the plurality of light emitting diodes;

(B) measuring, with a sensor in electrical communication with the plurality of light emitting diodes, a decrease in the temperature of the plurality of light emitting diodes, the decrease in temperature of the plurality of light emitting diodes corresponding to an increase in series voltage across the plurality of light emitting diodes;

(C) short-circuiting, with a bypass circuit operably coupled to the sensor, at least one first light emitting diode in the plurality of light emitting diodes in response to the increase in the series voltage so as to reduce the series voltage below the constant voltage provided by the constant-voltage power supply;

(D) enabling, with the bypass circuit, the at least one first light emitting diode; and (E) measuring, with the sensor, a change in the temperature of the plurality of light emitting diodes while the at least one first light emitting diode is enabled.

6. The method of claim 5, wherein (D) comprises enabling the at least one first light emitting diode for a period less than about 20 milliseconds.

7. The method of claim 5, further comprising:

(F) short-circuiting, with the bypass circuit, the at least one first light emitting diode after measuring the change in the temperature of the plurality of light emitting diodes.

8. The method of claim 5, comprising:

disabling the at least one first light emitting diode when the series voltage exceeds the constant voltage provided by the constant-voltage power supply.

* * * * *